US006145688A

United States Patent [19]

Smith

[11] Patent Number: 6,145,688

[45] Date of Patent: Nov. 14, 2000

[54] CLOSURE DEVICE FOR CONTAINERS

[76] Inventor: James C. Smith, 242 Roberts Ave., Hayward, Calif. 94544

[21] Appl. No.: 08/895,494

[22] Filed: Jul. 16, 1997

Related U.S. Application Data

[60] Provisional application No. 60/021,934, Jul. 17, 1996.

[51] Int. Cl.[7] ..... A61J 1/00; B65D 55/16

[52] U.S. Cl. ..... 220/259; 220/375; 220/847; 220/367.1; 215/306; 215/278; 215/DIG. 3

[58] Field of Search ..... 215/247, 248, 215/235, 237, 277, 278, 306, DIG. 3, 307–310; 220/254, 255, 256, 259, 833, 835, 837, 838, 839, 847, 367.1, 373, 374, 375; 604/403, 415

[56] References Cited

U.S. PATENT DOCUMENTS 5,271,531 12/1993 Rohr et al. ..... 220/259 X
5,287,983 2/1994 Reil et al. ..... 220/259 X
5,295,599 3/1994 Smith ..... 220/839 X
5,513,768 5/1996 Smith ..... 220/259
5,577,625 11/1996 Baird et al. ..... 215/235
5,738,233 4/1998 Burns ..... 215/247
5,833,088 11/1998 Kladders et al. ..... 215/248
5,863,655 1/1999 Mock ..... 215/306 X
5,931,828 8/1999 Durkee ..... 215/247 X

*Primary Examiner*—Nathan J. Newhouse

[57] ABSTRACT

An injection molded assembly forming a sealing device for a threaded or non-threaded container using a double cap concept with pressure responsive convex sealing; also disclosed is a wiping mechanism, a one piece construction, a tamper resistant construction, a limited air exchange construction while allowing easy access to fluid contents, a sterile air venting and filter construction, a one piece tamper evident closure with a tethered container, and a frangible thether means molded with the formation of the sealing device.

26 Claims, 11 Drawing Sheets

CLOSURE DEVICE FOR CONTAINERS

CROSS REFERENCE TO RELATED APPLICATIONS

This application claims the benefit of U.S. Provisional Application No. 60/021,934, filed Jul. 17, 1996.

FIELD OF INVENTION

This invention relates to plastic cap closures, specifically to an improved cap that will be used with threaded or non-threaded containers.

BACKGROUND OF THE INVENTION

This invention uses the Double Cap concept of my "Multiple Cap Seal for Containers" U.S. Pat. No. 5,295,599 issued Mar. 22, 1994 and the pressure responsive convex sealing diaphragm of my "Sealing Cap for Containers" U.S. Pat. No. 5,513,768 issued May 7, 1996.

Another area of this application relates to the wiping mechanism which was described in my Invention Disclosure "Screw Cap with Sealing/Wiping Diaphragm" dated Feb. 11, 1994 and a second version dated and filed Jan. 11, 1996 Disclosure Doc. 390080 with the Patent Office.

Another area relates to a one piece tethered cap and tube as described by my invention disclosure "One Piece Tamper Resistant Cap and Vial" Disclosure Doc. No. 384710 dated Oct. 10, 1995.

BACKGROUND OF INVENTION

Screw cap vials for microcentrifuge tubes have been used in the medical disposable industry for many years. Their continued acceptance comes from the fact that they provide the best leak proof design for centrifugation, heating and freezing of sample fluids. There disadvantages are primarily due to the fact that they are individually molded and usually require the assembly of an O-ring or liner to increase the sealing caps effectiveness. The major problem relates to a cost issue which makes this product (tube and cap) approximately 10 times the cost of an integrally molded cap microcentrifuge tube. Prior art has also demonstrated that thread seals alone are not dependable and the use of different materials in the construction of caps, seals and containers has caused leakage problems. This is due to the thermal expansion and contraction rates associated with different materials during testing and/or storage at high and low temperatures.

Another disadvantage of the prior art closures is the potential for contamination of not only the added O-ring elastomer used as a sealing ring in the cap but also the colorant used in the molding of the plastic closures. The fact that caps can also get misplaced or put back onto another vial by accident causes other contamination occurrences. This last problem has been addressed in the industry by the addition of a tethered strap to hold the cap to the tube with an additional part and increased cost. An example of this would be U.S. Pat. No. 4,753,358 by Virea which describes how this tether can be created as a separate piece and be used to hold the cap and tube together as a one piece assembly.

It is also known in the industry that chemical resistance of containers and closures is of the utmost importance. While most plastic assemblies are made from polypropylene or polyethylene, these materials still lack the chemical resistance and temperature requirements for all applications. It is known that Teflon (registered trademark of Dupont) and its injection moldable grades (PFA, FEP, TEFZEL etc.) are far superior for these uses but that they lack the mechanical properties necessary to hold the close tolerance for these applications. This new invention helps to solve these and many more problems associated with the prior art.

Another problem arises when the fluid samples are required to be accessed in the same container many times over or when the caps must remain off for extended periods. In both cases the fluids are exposed to atmospheric air exchanges which can cause contamination, evaporation, condensation and/or aging of the fluid sample which can affect the accuracy of any analysis being conducted on the specimens. The new invention addressed these concerns by limiting air exchanges yet still allowing easy access to the fluid contents.

This invention also relates to closures that promote sterile air venting and filtering of the container without the use of secondary plugs or permeable membranes used to maintain equilibrium between atmosphere and the inside of the container as illustrated in U.S. Pat. Nos. 2,186,908 & 5,595,907. This is accomplished by injection molding small (i.e. 5 to 50 micron) textured air channel vents into the sealing surface of the closure and/or container.

This invention also relates to a one piece tamper evident closure with tethered container. Unlike existing snap on, snap off or snap on, screw off tamper evident closures as taught by U.S. Pat. No. 5,190,178 U.S. Pat. No. 5,267,661, and U.S. Pat. No. 5,456,376 this invention has many advantages. The most apparent is the low cost one piece injection molded assembly. By molding as one piece, no orientation of the cap to its mating sealing threads during assembly is required. It only requires a downward axial force to engage a sealing surface. There also will be no fit or sealing problems due to multi-cavity processing, material shrinkage and/or tolerance problems because the closure and its container are being molded in the same tool at the same time with the same material (i.e. lot no.) unlike existing art under the same exact processing parameters. (i.e.: time, pressure, heat, humidity, etc.)

In addition, this invention also addresses the similar problems found with fitments as described by U.S. Pat. No. 5,174,465 and U.S. Pat. No. 5,348,184 which have many deficiencies. Even though these closures are mechanically attached to their fitment during the molding process, they lack the intragal tether to keep its potentially contaminated cap with its container after each use. They also include internal threads which are known in the medical industry to provide a means for capture of liquid particulates while also providing recessor for contaminants to solidify thus, effecting the sealing capability and contamination problems during re-use. Also the use of tamper evident foil seals are used for added sealing capability which adds additional costs and labor to these closures.

In addition, most containers are accessed with the use of a standard disposable pipette tip which is attached to a hand held pipetter in the medical industry. In normal operation when the tip is inserted into the fluid and the precise amount of sample is drawn inside the tip for transportation to another location, there exists a thin film of residue fluid attached to the outside of the tip. This is due to the surface tension of the material used to manufacture the pipette tip and the fluid characteristic of the sample. Common practice in the industry suggests that the outside of these tips be wiped clean with a KIMWIPE tissue prior to the dispensing cycle. This however, causes the following problems: 1) Requires the contact and disposal of an additional product (i.e. tissue); 2) Puts the user at risk while transporting highly infectious or radioactive fluids; 3) Reduces the amount of specimen that can be analyzed; 4) Adds cost and additional time necessary to perform dispensing. Some manufactures have added silicone to the polypropylene tip material (i.e. siliconized pipette tips) at additional cost to help reduce this problem, but still have not eliminated it. The thin film that is left on the outside of the tip usually combines to form small fluid droplets and could.

- Affect the accuracy of the calibrated sample if they combine with the precise volume that is being dispensed by the inside of the tip. This can occur if the tip touches the sides of the receiving container leaving its droplets to combine with the sample being transferred;
- Droplets can fall from the tip while being transported in or out of the container;
- Droplets can migrate to the tip's dispensing end and combine with the precision amount of internal fluid to affect the dispensing accuracy;
- Leads to cross-contamination or contamination in general, if any of the outside fluid were to contact any surface or thing (i.e. radioactive material or volatile fluids);
- In applications where samples are very small and precious any additional fluid that would be wasted by being attached to the outside surface of the tip could become very costly and would allow fewer test specimens to be examined.

This new invention addresses all of these concerns by providing an injection molded wiper as part of the closure to eliminate any and all residue occurring during transferring of fluids during liquid pipetting.

Another recurring problem with microcentrifuge tubes is the requirement to filter aqueous samples for clarification, particulate removal and/or sample preparation prior to the liquid being dispensed into the tube for testing. Prior art suggests the use of an additional filter assembly as manufactured by Gelman or Fisher Scientific be installed into the tubes opening to act as a funnel filtering all incoming fluids before entering the container. After the container is filled, this filter assembly must then be discarded and the tube can then be capped for storage or further testing. This not only becomes time consuming but the additional filter assembly adds cost and potential problems with contamination and disposal. The new invention addresses these problems with a one piece design.

Another problem arises when smaller more delicate tissue samples, used by histologists, are usually first put into small biopsy bags or separate open-mesh capsules then submersed into histological solvents, in a separate container, for storage. This new invention helps to reduce the number of parts and tasks associated with the technicians labor hours and tissue handling time by creating a new storage closure that addresses these issues.

Accordingly, there is a need for a simple cap closure that addresses all of these problems by reducing the time necessary to perform these operations, minimize the contamination problems, prolongs sample life and reduces the manufacturing costs.

For a better understanding of the invention and how this new cap closure overcomes these disadvantages, reference is made to the following Summary, Preferred Embodiments, Detailed Description and Drawings.

SUMMARY OF THE INVENTION

Accordingly to the invention, the problems mentioned above are solved by cap closures that increases the effectiveness of sample containment and withdrawal at a reduced manufacturing cost.

The present invention provides for a threaded cap design which incorporates a pressure responsive diaphragm that increases the sealing effectiveness of the cap when the internal pressures of the container increase during testing or storage (i.e.: centrifugation, heating and freezing). As an improvement to "Sealing Cap for Containers" U.S. Pat. No. 5,513,768, the cap and the container have seamless matting tapered surfaces which increases the sealing contact area as the closure is screwed onto the container and promotes an effective seal. Using the mechanical advantage of the threads to compress the tapered side walls of the caps convex sealing diaphragm, the interference between the cap and its container increases as the cap is rotated downward onto its final sealing position while bulging the convex sealing diaphragm outward. The increased tapered sealing area offers better sealing capability than the existing annular ring design that is common within the closure industry. It also offers a less expensive and better closure because of its one piece design as compared to the caps that required an additional elastomer to make its seal and the contamination problems associated with it.

According to another aspect of invention, the threaded sealing cap has a hinged access top/locking cap which has a mating taper area designed to engage and seal to the inside surfaces of the convex diaphragm. This angular surface provides additional support while sandwiching the sealing diaphragm side wall between it and the internal tapered side wall of the container. The attached top can be molded with a finger tab for access or can be molded with a permanent snap lock to create a one piece convex sealing cap closure for those applications not requiring access other than by complete cap removal. This closure is adapted to high integrity sealing applications wherein complete sealing is required under a wide range of temperature and pressure range conditions.

In another variation, the access/locking cap can be incorporated as a separate molded part. This would allow for colorant to be used for this cap for identification or labeling purposes while maintaining only virgin material for the part which may contact the fluid within the container. This eliminates the need for multiple stability evaluations in applications using colorant in caps while also allowing the use of standard automatic capping and unscrewing machines.

A further object of this invention is to incorporate the use of chemical and temperature resistant TEFLON fluorocarbon resin into the convex sealing diaphragm of the closure. This material which inherently has mechanical problems with close tolerance parts due to cold flow and memory loss requires additional support in applications such as these. This will be accomplished with the addition of a pre-formed back up spring, coil spring or compression of an elastomer O-ring that will exert constant radial pressure on the TEFLON seal insuring contact with the inside surface of the container (i.e. plastic, glass etc.) at all temperature and pressure variations. This becomes very important for those uses that require the use of chemically inert materials while also requiring large temperature variations during testing or storage. This closure is particularly adapted for cryogenic storage of organic samples.

Another object of this invention is to provide a low-cost, self-venting aerosol resistant closure. One particular area of concern is the reconstitution of toxic drugs, such as those used in chemotherapy. When diluent is added through a membrane or septum by a syringe needle, a positive pressure builds up in the sealed vial. Aersols containing the reconstituted drug can be released when the septum is punctured and fluid is injected, exposing personnel to potential contamination. By incorporating a low cost injection molded aerosol resistant vent into the closure itself or the needle assembly, would help to prevent the release of any contaminated aerosols that would normally be released due to the increased pressure of the sealed container as is common in existing products. Many other venting applications exist for containers or filters that require gas exchange between the inside of the vessel while preserving sterility and preventing fluid leakage. Another object of the invention is to provide a closure of the above type which is also adapted to permit withdrawal of the sterile liquid by means of a hypodermic needle or pipette tip. Another application would be the use of the very small molded channels on the outside surface of a filter adapter that would fit between a hand-held pipetter and a disposable pipette tip. This adapter would prevent aerosols from the drawn fluid in the tip from contaminating the pipetter barrel. These small vent channels can be injection molded in the 3 to 50 micron size and produce much better filtering results than that described in my "Aerosol and Liquid Transfer Resistant Pipette Tip Apparatus and Method" U.S. Pat. No. 5,580,529 issued Dec. 3, 1996. This injection molded filtering concept can help to eliminate need of an additional microporous membrane or filter material of the type made by the Porex Corp. usually required in sterile venting applications such as these and many more.

Another object of this invention is to provide a cap with a flexible tether attached to a molded container as an all in one injection molded assembly. This would provide considerable cost savings over existing art which sometimes require three individual components (i.e. cap, tube and tether) plus labor to accomplish the same end product. In a further embodiment the tether can be molded together with the tube with tamper resistant connecting ribs. In this embodiment the container could be filled with fluid, the cap and containers threads would be created with lead-in tapers on the top of the threaded profiles. This would allow the cap to be rotated about its tether and pushed directly downward over the threads to its furthest most sealing position without the need for cap rotation. This would simplify the filling cycle while also decreasing the time necessity for capping especially for automated equipment. To open the container, the user must now rotate the cap (unscrew) while also breaking the thin small tamper evident ribs connecting the attached tether to the container or cap, showing that the container has now been tampered with. The thin ribs could be designed with as few as one rib or multiple ribs depending on the requirements. In another variation, the user would break the contact rib or ribs prior to installing the cap onto the container. Another embodiment would be that the cap, tether and container was injection blow-molded in a one-piece assembly, the container would then be blown to a size larger than the original injection profile. This would allow larger containers to still incorporate the one-piece tether-cap design.

A further embodiment includes a tamper evident band, as part of the tether, which after assembly can be removed by use of a pull tab which breaks the thin rib or ribs that connect the tether to the container allowing the cap to be unscrewed. Another variation to secure the tamper evident closure to the container would be to form at least one projection on the locking wall of the container which engages a tamper evident ring during application. The ring or lower skirt is connected to the threaded upper skirt by means of a frangible section which like the tethered pull tab is removable by tearing and fracturing the frangible section. It is also understood the tamper evident ring could be molded to the containers locking wall with means for engagement to the upper skirt of the closure.

Unlike existing art, with separate cap and container, this invention incorporates the cap and container as one piece with a tether to insure the cap always stays with its container. This not only reduces cost but also allows the parts to be molded with much tighter tolerances especially in multi-cavity applications due to the fact that they are molded at the same time, using the same exact material under the same molding conditions. This also becomes very important in many high and low temperature applications where the thermal expansion of the material is exactly the same. These tethered embodiments could incorporate the new convex seal, wiping design, vented concept, filter design etc. or the standard threaded cap with liner if so desired.

In a variation of the above, the cap and tether with or without a tamper evident feature can be integrally molded to a threaded neck or fitment with a thin flange that can be attached to a separate polymer-coated paperboard container, plastic bag or other container constructions. This may be accomplished by welding the parts together or with the use of adhesive or other means of attachment known in the art. Because the fitment is unattached to its container at the time of molding, it then becomes possible to injection mold the closure directly over its mating threaded neck and assemble the two parts together with intragal tether during the molding cycle with a straight axial downward force. In this position the closure cannot be unscrewed without breaking the tethers connecting rib or without removal of the tamper evident pull tab.

In another variation, the fitment, cap and tether may also be molded in a one piece open configuration that would allow the further addition of a molded in tamper evident diaphragm within the spout. This diaphragm would act much like a foil seal in prior art applications and would require removal by means of a tear tab or the like prior to accessing the contents of the container of which the fitment had been attached. However, unlike the foil seal, this removable diaphragm requires no secondary assembly or another part.

It is a further object of this invention to provide a closure with wiping mechanism for pipette tips which effectively removes all the liquid from the outside surface of the tip as it is withdrawn from the vial while still incorporating an access cap that can be resealed after use. More particularly, a one piece injection molded closure which incorporates a conical section with a spiral finger or fingers designed to resiliently expand and contract about a tubular conical pipette tip maintaining contact at all times with its outside surface while wiping and removing the fluid film or droplets from its surface. Again, it is difficult to compensate for the amount of fluid left behind clinging to the outside of the pipette tip because it varies by the nature of the fluid, its characteristics and more often by the technique of the person doing the pipetting. Even the most experienced technician will have inconsistencies because of interruptions which in effect can void test results. However, this wiping feature eliminates the above mentioned problems while more importantly, saving time and increasing sample life.

The wiper section can be incorporated into my two cap design "Sealing Cap for Containers" Patent Application U.S. Pat. No. 5,513,768 by replacement of the sealing cap with a wiping cap design. This allows the user to first fill the container, then rotate the wiper cap into the container opening, and rotate the locking cap into the wiper opening, thus sealing and locking the container. To access the fluid, the locking cap must then be rotated outward, a pipetter with tip would then pass through the conical wiping fingers accessing the fluid within. Upon removal the wiping fingers would wipe and remove all the fluid that had attached itself to the outside surface of the tip while keeping it within the container. Unlike normal procedure, there would be no need to wipe clean the outside tip with tissue before transporting the sample. This feature also greatly reduces the amount of contamination that can occur while also saving precious fluid samples and time. It also helps to minimize air exchanges within the container by providing minimum size openings compared to open neck containers. This helps to reduce airborne contaminates from both entering and exiting the containers while also increasing the life of the fluid specimen due to evaporation or aging of the sample.

Another variation of this wiper design incorporates the use of a thermoplastic elastomer similar to that made by Monsanto Chemical Company under the trademark SANTOPRENE. Using this rubber-like material allows the design freedom to injection mold a very thin wiping diaphragm with a small opening incorporated into the closure itself. As a one-piece assembly, the entry hold will expand and contract about the conical pipette tip while wiping the outside surface free of any liquids. By incorporating thickened wall sections for the threaded skirt and access cap area, the mechanical properties will increase thus giving more stability to the rubber-like material in the snap and threaded areas for this one piece injection molded closure. This unique material offers many advantages over hard plastic such as polypropylene or polyethylene that is commonly used in these closure applications. Another variation would be to injection mold this one-piece threaded skirt and access cap with a thin septum. This would allow aseptic injection of reagents or withdrawal of fluid without compromising sterility or integrity of the contents. This one-piece design, unlike existing art, could be used with or without the access cap for convenience especially in automated dispensing machines. It would also be beneficial to incorporate the venting aspect of this invention into either the cap or the container to encourage sterile venting when the fluid is accessed.

It is a still further object of this invention to provide a one-piece closure that would incorporate a molded-in screen type openings for straining or screening aqueous solutions before entering the container. A variation of this would be to sealably attach a woven monofilament screen (i.e.: polyester, polypropylene, TEFLON etc. from 5 microns and greater) to the cap for sterile pre-filtering of any solution containing particles. Another variation of this embodiment would include the addition of a hydrophilic, hydrophobic or oleophobic microporous filter membrane (i.e. 0.02 to 0.45 micron pore size) that would be sealably attached to the closure and be useful in sterilizing or clarifying biological samples by removing interfering particulates from blood, urine or other fluids that may be cause for inaccurate readings during analysis before they enter the container. Membranes can also be used to remove bacteria cells from media, DNA purification and filter any fluid. They can also be used to introduce a predetermined volume of dry reagents into the liquid sample causing a color change, reflectance or electrical conductivity. An example of this might be with the access cap open, a sample of urine or serum is dispensed into the cap cavity, it wets out and moves though the porous matrix and it solubilizes one or more reagents that have been previously deposited into the filter membrane bed volume and into the container. This would allow manufactures to ship its containers with pre-loaded reagents that would be required to complete an analysis or test requirements. Another variation would be to fill the cavity of the cap with dry reagents that would mix with the incoming fluid. This internal cavity when filled with dry reagents could also be made with a multitude of small openings that would hold the pelletized reagent but would mix thoroughly with the containers liquid when the cavity holding the reagents drop below the fluid level of the container. This mixing could occur by hand or with the use of an automated tube shaker. Another variation would be to incorporate a hydrophobic membrane into the cap, fill it with a pre-determined volume of fluid, seal the closure, fill the vial with a pre-determined volume of another fluid, when centrifuged, the two fluids would mix together. Sterile venting both the closures fluid compartment and vial become necessary to insure fluid flow during centrifuigation.

Another variation using a hydrophobic membrane would be to fill this internal cavity with oxygen scavenging pellets such as AGELESS manufactured by Mitsubishi Gas Chemical Corporation, Inc. or, OXYGUARD by Toyo Selkan that would absorb oxygen from the gases contained within the headspace of the sealed tube or oxygen that may ingress into the container. This would prolong the life of oxygen-sensitive samples and decrease the aging effects associated with oxidation. Pellets of another type could also be used to absorb moisture that would be beneficial in the storage of dry materials when a hydrophilic filter membrane was used in the closure assembly.

It is also an object of this invention to create a simplified one piece tissue storage container for use by histologists. By incorporating small openings into the cavity formed by the cap closure, you have created a storage vessel that can be used to hold tissue samples while being submersed into the fluid of the container. The samples can then be accessed through the access cap or can be withdrawn from its storage container by the complete removal of the threaded cap or screwed onto other containers for further evaluations.

The above is a brief description of some deficiencies in the prior art and advantages of the present invention. Other features, advantages and embodiments of the invention will be apparent to those skilled in the art from the following description, accompanying drawings and appended claims.

DESCRIPTION OF INVENTION

Figure 1:
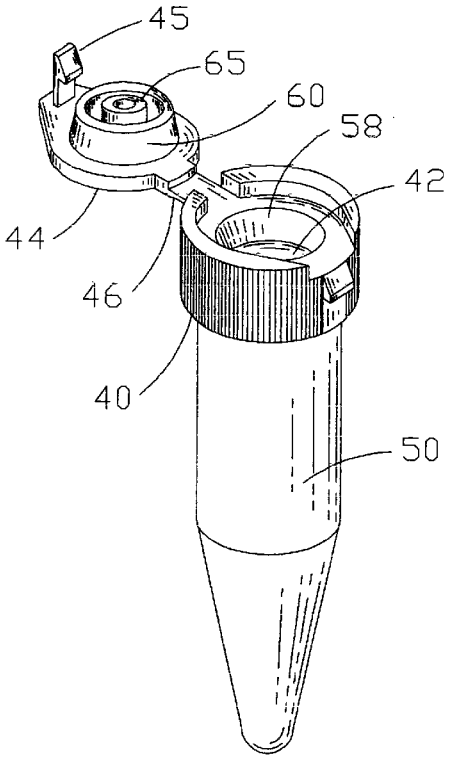
FIG. 1 is a perspective view of the convex sealing closure with tab in the open position.

Referring to the drawings in detail, preferred embodiments of the cap closures are illustrated in accordance with the principles of the present invention. Although the illustrated embodiments of the cap closures are shown in conjunction with a centrifuge container or tube, it should be understood that they can be used with any containers such as bottles and thee like.

Figure 2:
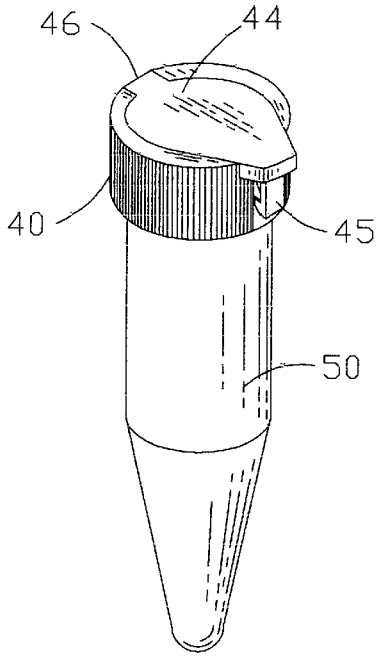
FIG. 2 is a perspective view of the closure in the sealed state.
Figure 3:
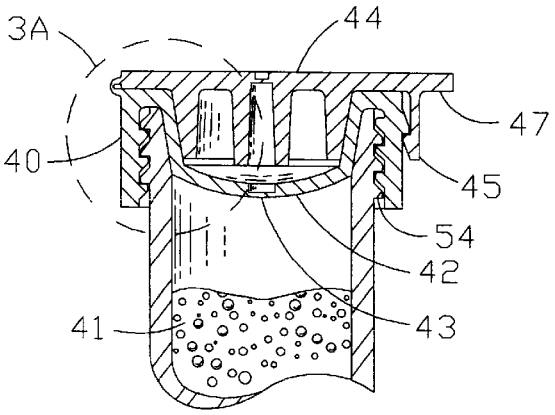
FIG. 3 is a side section view of FIG. 1

Referring to FIGS. 1–4, the threaded linerless cap 40 includes a pressure responsive sealing diaphragm 42 and access cap 44 hinged to the threaded cap 40 by a hinge 46. FIG. 1 shows the perspective view of the closure in the open position attached to a disposable centrifuge container 50. In this as-molded condition the user may access the contents of the tube after testing by puncturing the diaphragm at the minimum wall section 43 with a syringe type needle and then reseal the contents. This technique for sample withdrawal minimizes any air exchange within the tube. It also wipes the excess fluid from the needle upon withdrawal. FIGS. 2 and 3 show the access cap 44 in the sealingly closed and secured position using finger lock 45 to hold access cap 44 into position. Access tab 47 would be used to open access cap 44 for fluid withdrawal if needed.

Figure 4:
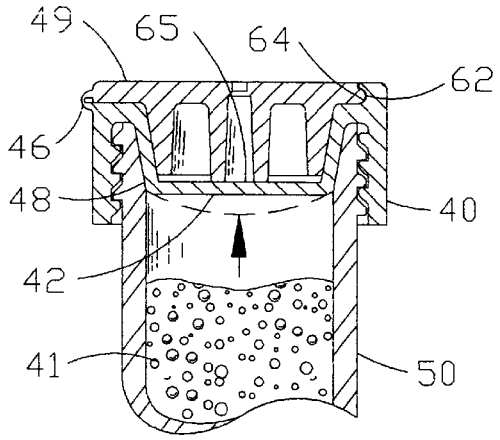
FIG. 4 is a side section view of a deflected convex sealing closure with internal pressure.

During installation of this cap onto its threaded container the angled sidewalls 48 of the convex sealing diaphragm 42 begin to mate with the angled sidewalls 52 of tube 50 as the threaded cap 40 is rotated downward onto threads 54 of the tube. Allowing the threads to engage first, the diaphragm walls 48 will compress to meet the angled wall 52 of the tube 50. While bulging the convex sealing diaphragm 42 downward into container 50. Interferences of these two angular walls can be increased due to the huge mechanical advantage that is offered by using threaded components. The increased interference or sealing capability is additional reinforced because the outside of tube threads 54 are being prevented from being pushed outwardly due to its containment by the threaded portion of skirt 56 of cap 40 enhancing the integrity of the seal. Additional support is added to the inside wall 58 of the sealing diaphragm by the angled wall 60 of the access cap 44. This additional support actually sandwiches the sealing wall diaphragm 48 & 58 between wall 60 of the access cap and wall 52 of the tube container to insure this leak-proof design. Additionally, when the tubes contents increases in pressure due to testing (i.e.: centrifugation, freezing, heating etc.), as shown in FIG. 4, the convex seal 42 will compress upwardly and apply an outward radial pressure to sealing wall 48, thus increasing the sealing effectiveness of the cap when most needed. The convex sealing wall 42 is prevented from going beyond flat due to finger projection 65 of access/locking cap 44. This design in conjunction with the increase pressure responsive seal properties of the convex diaphragm (see Sealing Cap for Containers) would eliminate the need for an additional sealing ring or liner used in prior art screw caps. This one-piece injection molded closure usually manufactured from polypropylene or polyethylene material, reduces the manufacturing and labor costs associated with screw caps with liners.

An alternative embodiment as shown in FIG. 4, 4A, 4B and 4C creates the same sealing benefits as mentioned above except the access cap 49 is permanently attached in the closed position. This is accomplished by creating an undercut snap 62 in the threaded sealing cap 40 top and by adding a snap projection or ring 64 to the access cap 44 to mate with this undercut as shown. This one-piece design would resemble the standard screw cap design with the added feature of the pressure responsive convex sealing design without the need for an o-ring or sealing liner. Also the hinge 46 would be of a minimal length to prevent any upward movement of the access cap 40 when in its closed position.

Figure 4A:
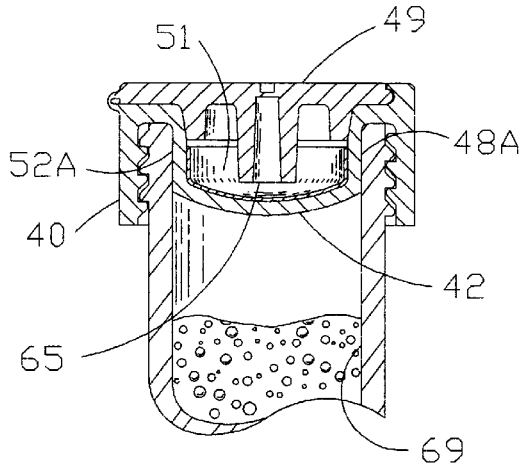
FIG. 4A is a side section of a convex sealing closure with back-up spring.
Figure 4B:
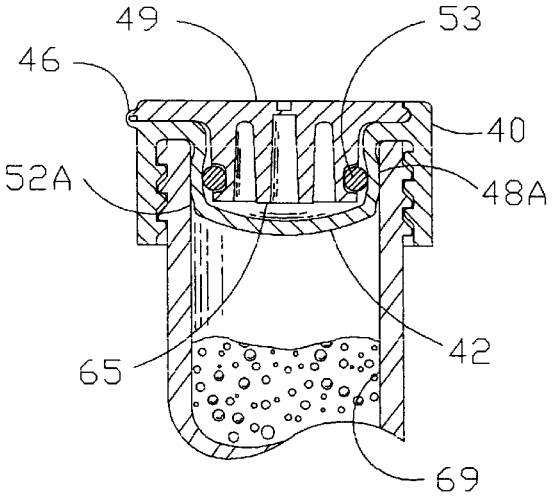
FIG. 4B is a side section of a convex sealing closure with o-ring back-up.

FIGS. 4A and 4B show alternatives variations of the closure invention when the need arises for improved chemical resistance, large temperature variations and/or pressure gradients. This variation includes the use of TEFLON (i.e.: TFE, FEP, PFA, TEFZEL, etc.) which meets the above requirement. However, the major drawback of this material is its inability to hold close tolerance conditions over its operating range due to its inherent cold flow properties. This invention addresses these deficiencies by adding an additional spring bias to counteract the cold flow properties of this material in its sealing applications.

FIG. 4A shows a variation of FIG. 4 by adding a support back-up domed spring 51 which is installed within diaphragm 42 and preloaded to exert radial pressure to the sealing surface of the diaphragm wall 48A against the inside surface 52A of the container 50. It is also understood a coil spring or other means could be used to exert radial pressure. FIG. 4B shows another alternative design incorporating an elastic o-ring 53 under compression used to exert an outward radial pressure to the sealing wall diaphragm 48A to increase the sealing effectiveness of the diaphragm side wall. Also using the pressure responsive diaphragm 42 increases the sealing capability when the internal pressures of the container 50 increase, thus deflecting the diaphragm upwards until it bottoms against access cap finger 65 while applying radial pressure outwardly increasing the sealing capability of the closure. It is also noted that at no time does the diaphragm go beyond its center to become flat or concave as this defeats the purpose of the seal design.

Figure 4C:
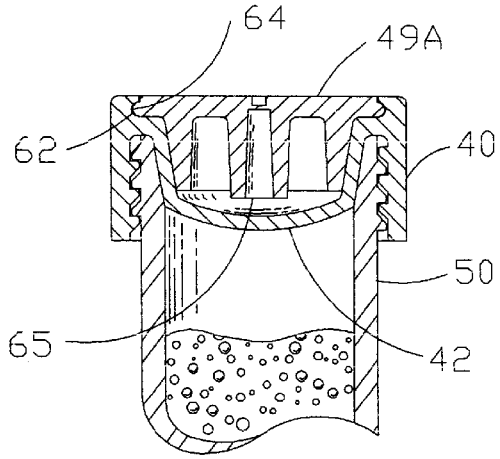
FIG. 4C is a side section of convex sealing closure with separate locking cap.

FIG. 4C shows another embodiment of the invention where the locking cap Item 44A is molded independently from the threaded sealing cap, Item 40. This allows the sealing cap which has fluid contact, to be manufactured from a virgin material with no additives while the locking cap, Items 44A, can be molded with different colorants or labeling for identification uses in the laboratory. This independent locking cap would function in a similar manner as previously discussed, except it would include a snap means, such as Item 64 that would mate with undercut Item 62 about its circumference to permanently attach the two parts together. This embodiment allows color coding of the caps while preventing colorants or other additives to migrate into the containers fluid sample and contaminating the solution.

Figure 5:
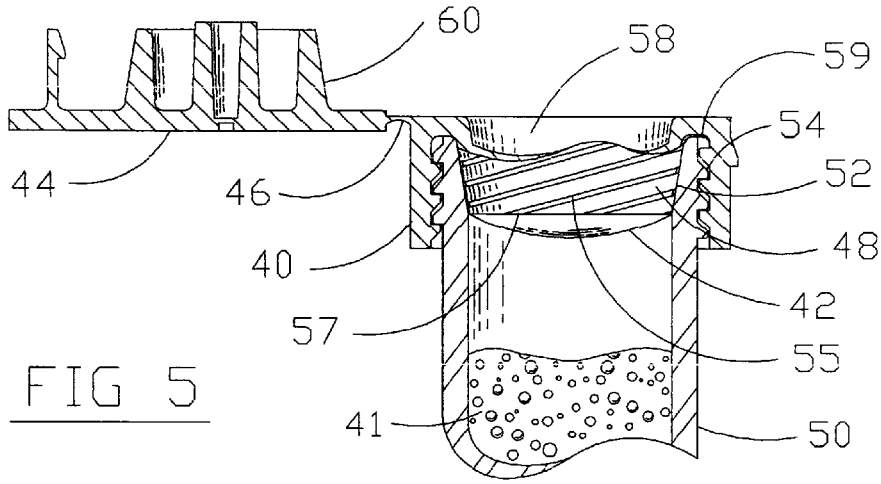
FIG. 5 is a side view illustrating venting channels.
Figure 5A:
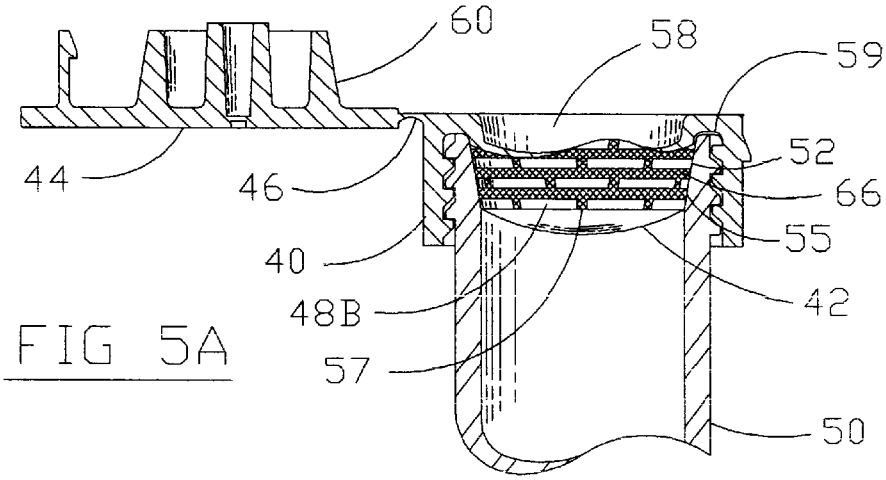
FIG. 5A is a side view with textured vented channels of a sealing closure.
Figure 5B:
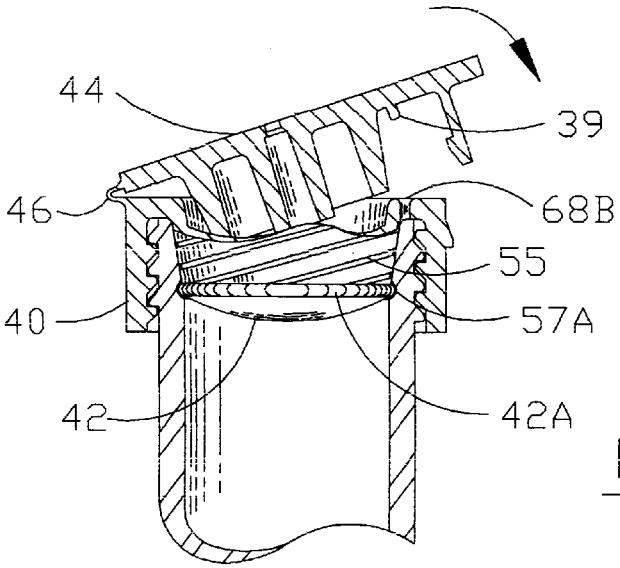
FIG. 5B is aside section with vented channels and convex sealing bead with locking cap having means to stop venting.

As shown in FIGS. 5, 5A and 5B the closure has been modified to include small venting channels which will maintain a sterile equilibrium between the atmosphere and the inside of the container while preventing leakage. In one embodiment, the channels, 55, are small thread type passageways (i.e.: 3–50 microns deep) that form openings between the sealing surface, Item 48, of cap, Item 40 and the sealing surface, Item 52 of the tube, Item 50, creating a small leak path between the inside and outside of the container. It is also understood these small channels or variations thereof could also be formed on the sealing surface, Item 52, of the container, Item 50. The leak path or passageways begin within the container at point, Item 57, and spiral upward about sealing surface, Item 48, until exiting the cap, Item 40, through additional passageways, Item 59, which allows outside access through the tube threads, Item 54. This long, very small passageway inhibits the flow of aerosol particles due to the frictional contact of the aerosol with either opposing wall forming channel, Item 55. This causes any fluids to condense and be redirected back into the liquid receiving chamber, Item 41.

FIG. 5A shows a variation of this invention using a maze of sealing surfaces, Item 48B, separated with channel vents, Item 55, that are formed with a molded-in textured surface, Item 66, that will create a multitude of small projections or passageways. (i.e.: 3–100 microns) that will help to create a filter-like structure for air to flow through. These texture configurations will be chemically etched into the injection mold tooling cavities that will create these products. A process such as Mold Tech can reproduce any singe or multi-level textured surfaces that would be required for many filter applications. An example of this concept would be to incorporate existing Mold Tech textures such as MT1055-1 (i.e. 0.0001 inch), MT 1055-3 (i.e. 0.0005 inch) and MT 1055-5 (i.e. 0.001 inch) into a multi-level configuration or filter texture pattern that would be a low cost alternative to secondary membranes or porous plastic filter plugs such as manufactured by Porex Technologies. It is understood this new invention can be reproduced to exact specifications and configurations to meet the exact design criteria for these prior art applications at a much reduced cost.

Another embodiment of the filter/vent design is shown in FIG. 5B where the diaphragm seal 42A is shown in its convex, relaxed condition. The release path for air is shown to move about seal 42A through annular recess 57A and into the channel vents, Item 55, above it. The sterile air can then escape as an alternative through hole 68B which can be plugged when Item 39 of access 44 is in the locked position. With cap 44 open, this embodiment allows minimum air to escape until such time the internal pressure of the vessel deflects the convex sealing surface 42A upward preventing any more leakage to occur about seal 57A which will then be closed due to the upward reflection of convex diaphragm 42A applying a radial pressure to seal 42A into recess 57A. This embodiment could be used as a safety mechanism to prevent unwanted leakage at high or low temperatures.

Figure 16:
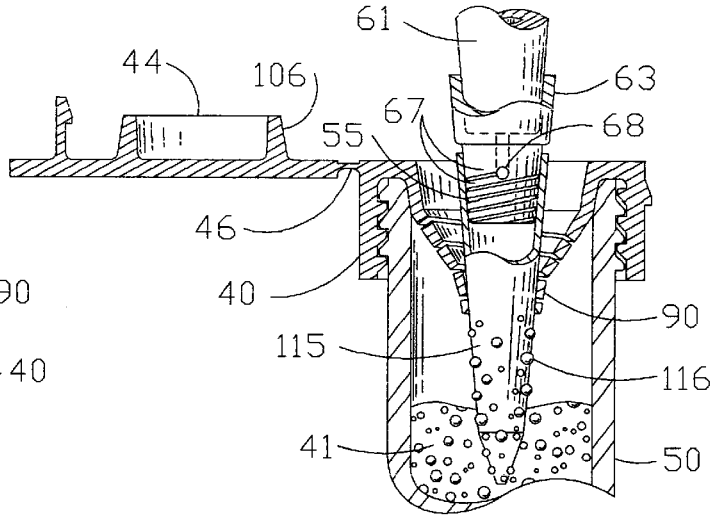
FIG. 16 is a side section of FIG. 15 showing a pipette tip in the container ready to be wiped clean of all outside fluid by wiping finger with aerosol resistant filter adapter.

This concept can also be used to filter aerosol contaminants from contacting a pipetter barrel of a pipetter, FIG. 16, Item 61, when used as a filter adapter, Item 63, between a disposable pipette tip, Item 115, and a pipetter as shown in FIG. 16. The filter adapter, Item 63, provides a means to prevent contaminates from the liquid, Item 41, drawn into the pipette tip 115 from reaching the pipetter barrel, Item 61. The small passageways, Item 55, (i.e.: 3 to 100 microns) are created on the outside sealing surface, Item 67, of the adapter 63 with a small hole, Item 68, that channels air from the inside pipette tip, Item 115, through passageway, Item 55, and into adapter, Item 63, which is sealingly attached to the pipetter barrel, Item 61. It is also understood this invention can be created as a one-piece design whereas the filter adapter, Item 63, would be molded with the pipette tip, Item 115, by means of a flexible hinge. This filter adapter 63 prevents aerosol contaminates from fluid 41 from contaminating pipetter barrel 61 by only allowing sterile air to pass when fluid 41 is drawn into pipette tip 115 by means of a pipetter.

Figure 6:
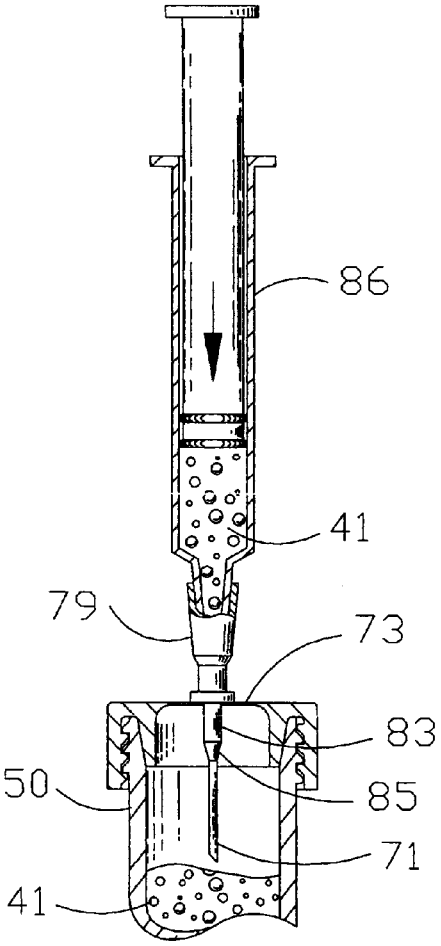
FIG. 6 is a side section of vented needle device in a sealed container.
Figure 6A:
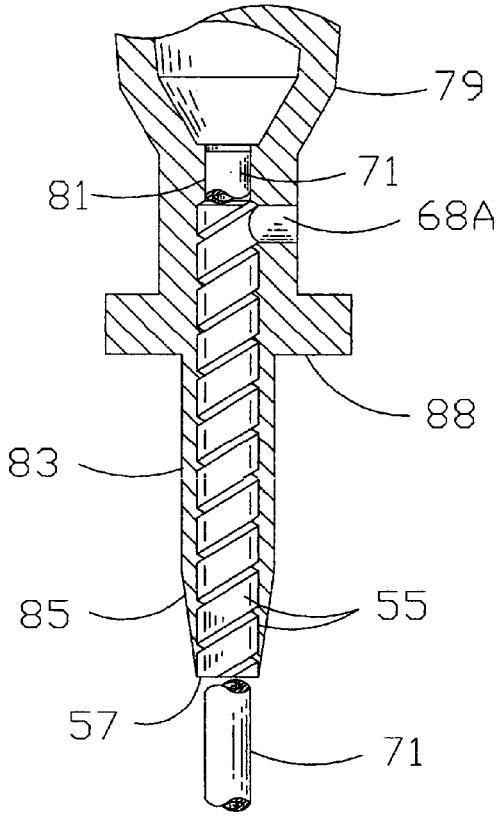
FIG. 6A is an exploded view of FIG. 6.

Another aspect of this embodiment is shown in FIG. 6 where a syringe, Item 86, with needle, Item 71, is puncturing septum, Item 73, and injecting fluid 41 into a non-vented tube, Item 50. In this application, the sterile air is channeled through the small passageways, Item 55, of the needle hub, Item 79, where it escapes to atmosphere through hole 68A as shown in FIG. 6A. The needle, item 71, is hermetically sealed to the hubs inside diameter, Item 81, by means of insert molding, press fit, adhesives etc. The thin wall section, Item 83, (i.e.: 0.010) with tapered nose, Item 85, provide for easy entry and exit into and from septum, Item 73. There also is a mechanical stop, Item 88, which prevents over penetrating the needle assembly through septum, Item 73, to beyond the exit hole, Item 68A while also inhibiting the release of contaminated aerosols through the punctured septum hole. It is also understood the vented passageways, Item 55, or texture Item 66 could be manufactured on the outside surface of the needle tubing prior to it being attached to plastic hub, Item 79, and still function in the same manner as described. It is also understood textures surfaces 66 could also replace vent channel 55 of the needle hub 79.

Figure 6B:
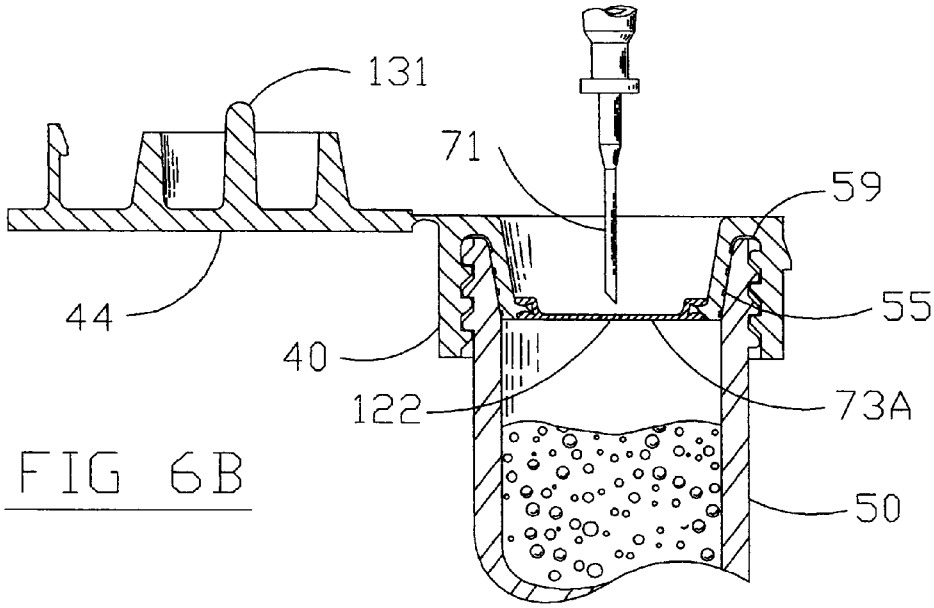
FIG. 6B is a side section of vented closure with septum (insert molded).

FIG. 6B shows a vented closure cap as shown in FIG. 5 with the addition of a insert molded self-sealing thermoplastic elastomer septum, Item 73A. This configuration allows for aseptic injection of reagents or withdrawal of sample without compromising the sterility or integrity of the contents by venting the sealed closure 40 through vent channel 55. The septum can also be manufactured with a break away hole allowing the entry of a standard pipette tip for accessing the fluid contents. In this case, the thermoplastic septum would enlarge and contract about the outside of the tips 115 surface to help wipe clean any residue fluid left during withdrawal of the tip. The access cap, Item 44, could be manufactured with a finger projection, Item 131, that would plug or seal this opening for further use.

Referring to FIGS. 7–10, attention is directed toward the attachment of the threaded cap 70 to its tube 50 by means of a tether 72 as a one-piece injection molded assembly. The helical threads are shaped and the closure is resilient, so the threads will slip past one another until such time that the internal seal of the closure is made preventing further upward movement of the closure until it is unscrewed from its container. In this embodiment the closure can be applied in a direct, axial downward direction without any requirement for rotation as in prior art application. Prior art also suggests the use of up to three individual components, cap, tube and tether to accomplish this same assembly. However, this new invention affords the one piece design with additional features.

First, the thread profile of cap 70 in created with a lead-in angle 74 on one side that would mate with the lead in angle 76 of the tube 50. The opposite side of the thread profile as shown by 75 and 77 could be square or buttress to increase the holding strength of the thread once the cap is secured. This design allows the cap 70 to be listed about its hinge/tether 72 onto the tube and pushed downward with an axial downward force to the sealing and locked position shown in FIG. 7C, without the need of rotating the cap as had been done in previous art. This could be accomplished by hand or with automated assembly after the tube 50 had been filled. As shown in FIG. 7B, a cross section of FIG. 7A, the tether, 72 is molded to a slide ring 78 that is attached to the tube 50 by small ribs 80 at one or more places that become very thin at location 82 shown in FIG. 7A. These thin wall sections 82 are designed to shear off when cap 70 is rotated. As shown, these connecting ribs are very important to the invention by accomplishing the following: 1) They allow the parts to be molded as a one-piece assembly; 2) They orient the cap 70 to container 50 to insure the sealing and engagement of the threads upon installation; 3) They can be used to show evidence of tampering after the cap is snapped into position as shown in FIG. 7C; 4) After shearing, these thin small ribs 80 and 82 help to keep the tether slide ring 78 attached to tube 50 by preventing its slippage beyond container ring 84. FIG. 7A shows another embodiment where container 50 has been enlarged to Item 87 using a two stage injection blow-molded process for those applications requiring larger volume containers.

The conventional tether cap use would also be applicable to this design by filling the tube 50, breaking the tether ribs 80 at point 82 and then rotating the cap 70 onto its sealing position. This variation, however, is not tamper evident as is the previous example but still provides a low cost alternative to existing products on the market and could be accomplished in the injection mold at the same time the product is being manufactured, if so desired. Additionally, cap 70 could also incorporate any other variations of this invention (i.e.: convex diaphragm, wiping diaphragm, venting etc.) to further enhance its capability as a multi-functional closure.

Figure 7:
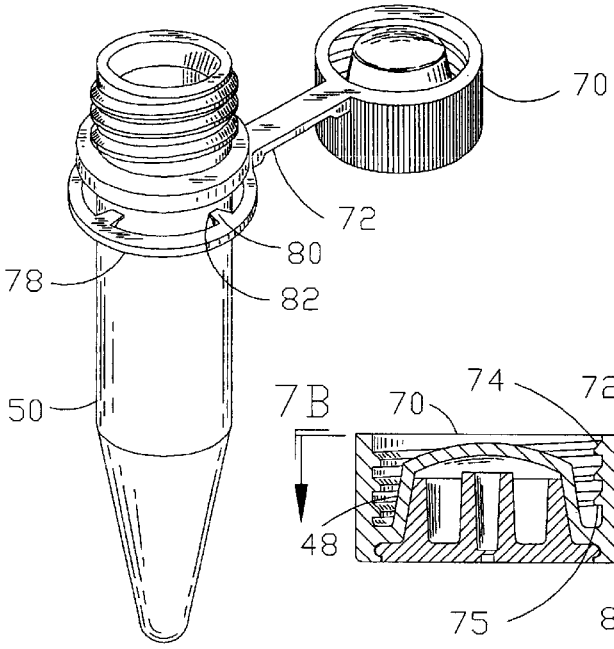
FIG. 7 is a perspective view of the tamper evident closure with integral tether and cap. (Snap on - screw off)
Figure 7A:
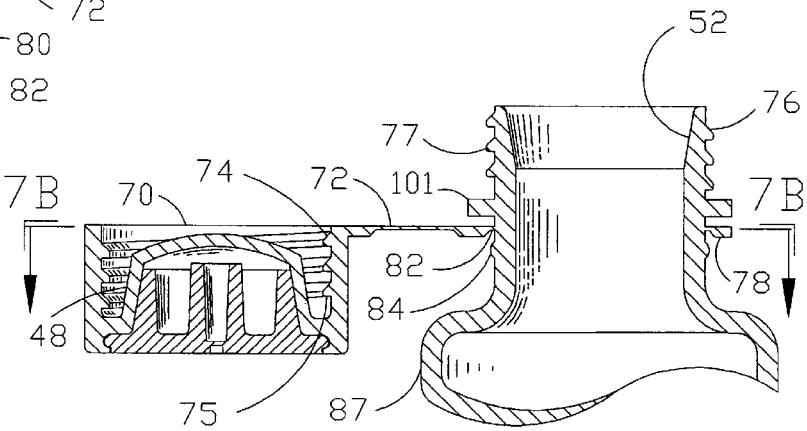
FIG. 7A is a side section of FIG. 7 in an as-molded condition.
Figure 7B:
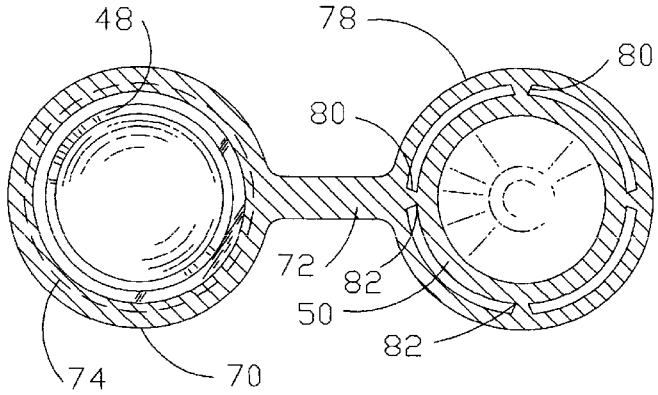
FIG. 7B is a section through FIG. 7A showing tethered bridges.
Figure 7C:
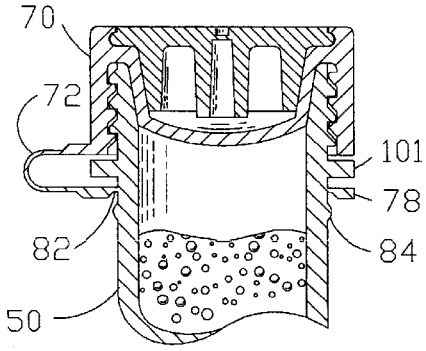
FIG. 7C is a side section of FIG. 7 in the sealed position.
Figure 8:
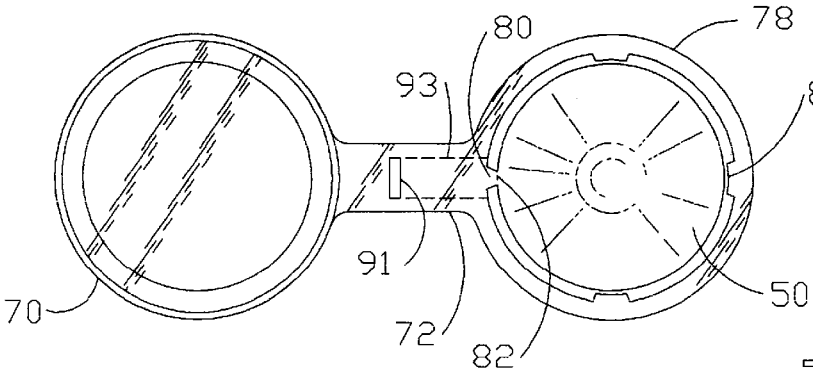
FIG. 8 is a bottom view of a tamper evident closure assembly with removable pull tab. (Snap on - screw off)

Another embodiment, FIG. 8, shows a variation of FIG. 7 with a tamper evident tether, Item 72, being connected to tube 50 by means of fragile bridge, Item 82. Item 82 is attached to a tamper-evident pull tab, Item 91, which is connected by a frangible section, Item 93, which is removable by tearing and fracturing the frangible section by use of pull tab, Item 91. This then allows the screw cap, Item 70, after installation, to be rotated and unscrewed from its container, Item 50, while still keeping the cap with its container by means of tether, Item 72 while also showing the closure had been tampered with.

Figure 8A:
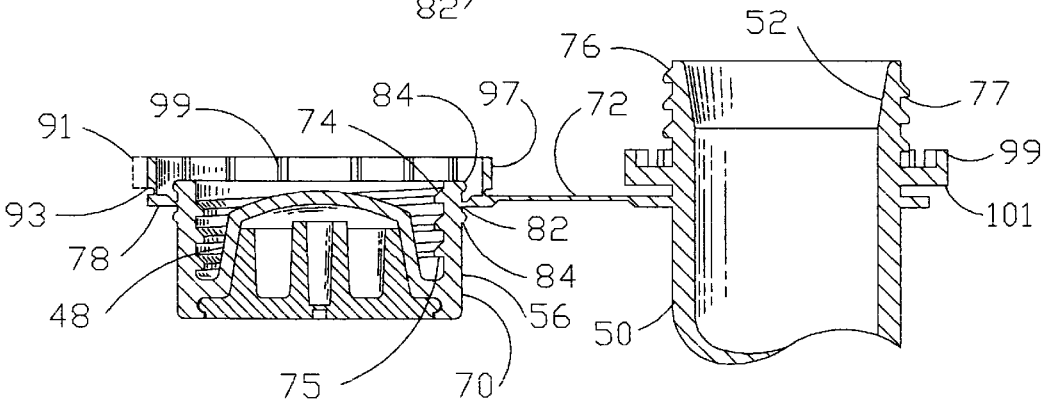
FIG. 8A is a side section view of a tamper evident closure assembly with tamper evident tether with removable tear tab. (Snap on - screw off)
Figure 8B:
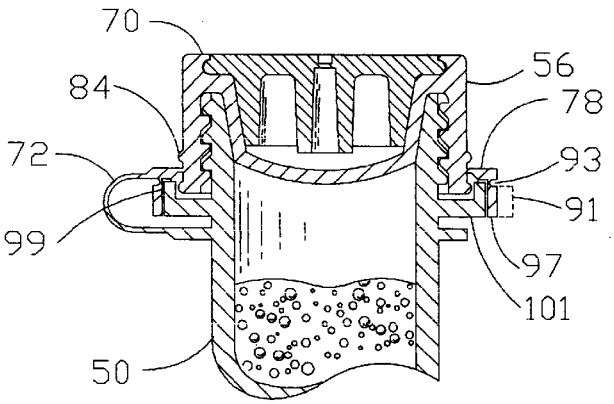
FIG. 8B is a side section of FIG. 8A shown assembled.

FIGS. 8A and 8B shows another embodiment of a one-piece tamper-evident, snap-on screw off closure tethered to its container. The closure, Item 70, has an upper skirt, Item 56, having internal thread profile, Items 74 and 75, mating with neck threads profile, Items 76 and 77. A conical tethered skirt, Item 97, is connected to the tethered slide ring Item 78 by a plurality of frangible bridges or a line of weakness, Item 93. The tethered skirt, Item 97, engages one or more anti-rotate projections, Items 99, which are formed along shoulder locking wall, Item 101. The tear tab or pull tab, Item 91, provides means for removing the tethered tamper evident skirt, Item 97, thus allowing the cap, Item 70, to be unscrewed while also allowing closure to rotate freely in the captured slide ring 78 to insure closure cannot be removed from tether 72. It is also understood the tethered skirt or tear tab could be molded to the tube shoulder, Item 101, via a line of weakness, Item 93 to become a lower tamper evident skirt. The lower skirt would have recesses to accept anti-rotate projection molded to the underside of the upper skirt, Item 56, of the closure, Item 70. Again, the lower skirt would have to be removed prior to allowing the closure to be unscrewed.

Figure 9:
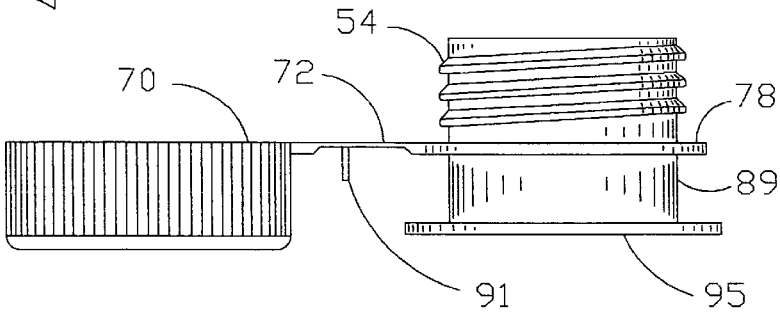
FIG. 9 is a side section of integrally molded cap, tether and neck with tamper evident slide ring. (Snap on - screw off- shown in the as molded condition)

FIG. 9 is a similar embodiment as FIG. 8 except the tether, Item 72, is attached to fitment, a threaded neck with a thin flange, Item 95, for mounting this tamper-evident configuration to a polymer-coated paperboard container or other container constructions.

Figure 9A:
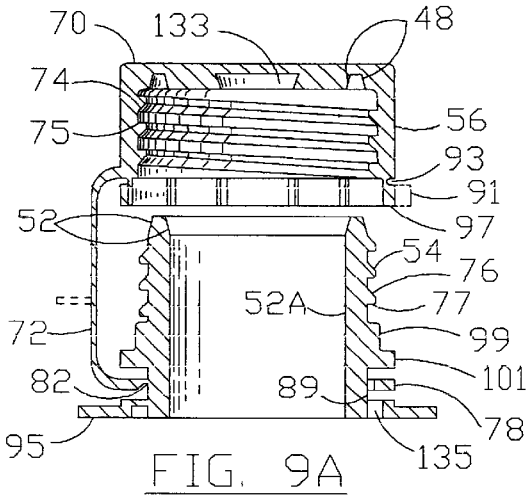
FIG. 9A is a side section of a tamper evident fitment with external threads molded w/cap and tether prior to assembly in the injection molding tool.
Figure 9B:
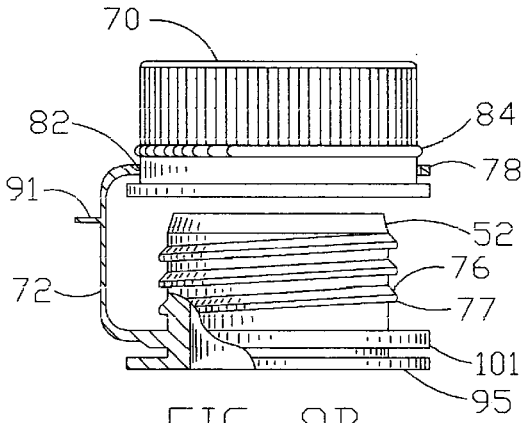
FIG. 9B is a side section of a fitment with external threads molded w/cap and tamper evident tether attached to cap.

FIG. 9A shows a as-molded embodiment similar to FIG. 8B except the closure Item 70 is being manufactured directly above a fitment with neck threads 54 for in-molded assembly of these two parts connected by tamper evident tether, Item 72. The inside configuration details including thread profiles, Item 74 and 75 of closure 70, are created in the tool using a collapsible core (not shown) similar to that being manufactured by DME. This specialty core allows for the larger internal threads and details to be molded, then the core collapses into a smaller diameter, thus allowing it to be retracted through the opening forming inside neck wall 52 of the fitment. As it retracts, an optional recess 133 in cap 70 creates an undercut in the core (not shown) insuring the cap 70 retracts with the core assembling cap 70 onto threads 54 until angled seal 48 mates with angled neck seal 52 (assembly not shown). Optionally, Item 135, provides an access opening (tooling passcore) to help form the openings between tether ring 78 and neck 89. FIG. 9B shows a further modification of this invention by attaching the tethered tamper evident ribs 82 to the closure 70 via a tamper evident tethered pull tab 91 similar to that shown in FIG. 8.

Figure 9C:
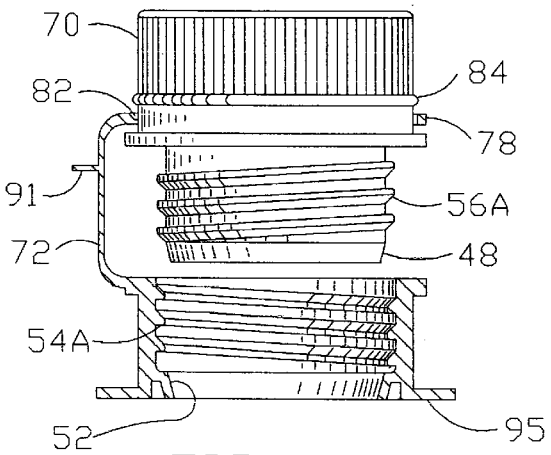
FIG. 9C is a side section of a fitment with internal thread molded w/cap and tether with tamper evident pull tab prior to assembly in tool.

FIG. 9C shows a further modification where cap 70 is modified to include external threads 56A which mate with internal fitment threads 54A. This embodiment will be molded and assembled as FIGS. 9A and 9B except this configuration does not require the need of a collapsible core as do the prior embodiments. Its application is somewhat limited due to the disadvantage of the internal threads as previously discussed. It however, could find uses in non-medical applications.

Figure 9D:
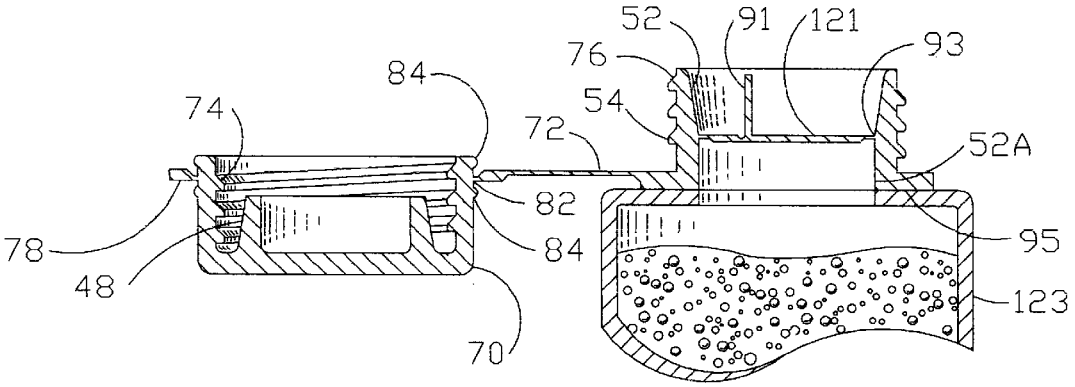
FIG. 9D is a side section of a fitment with tamper evident tether and a removable tamper evident spout diaphragm.

FIG. 9D shows a further modification to include a molded-in tamper evident sealing diaphragm, Item 121, with removable pull tab 91. It is molded with frangible section 93 which attaches to inside neck wall 52A below angled sealing surface 52. Neck flange 95 is sealing attached to carton Item 123 after it is filled with fluid or other contents. To access container 123, cap must first be unscrewed by breaking tethered bridges 82 and removed as shown in FIG. 9D. Tear tab 91 is then pulled to fracture the frangible section 93 about its circumference allowing the tamper evident diaphragm 121 to be completely removed, thus, allowing the contents of the container to be accessed. It is also understood this embodiment can be used in a snap on, snap off configuration along with other embodiments of this invention.

Figure 10:
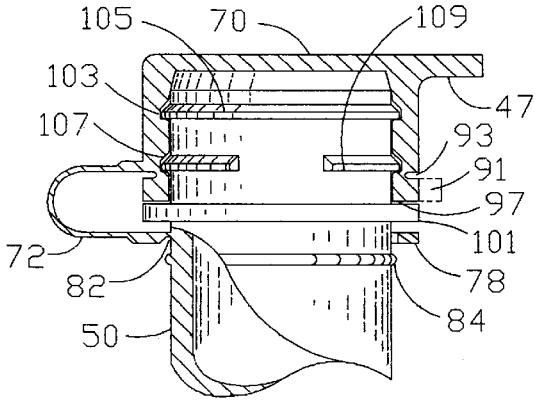
FIG. 10 is a side section of a tamper evident closure with a pull tab. (Snap on - snap oft)

FIG. 10 is a snap-on - snap-off, vented one-piece closure with tamper-evident band. Closure, Item 70, has two undercuts molded within its two skirts. Item 103, is a snap recess on the upper skirt that mates with a snap projection, Item 105, on the neck of tube, Item 50. Item 107, is at least one partial recess that mates with at least one projection snap, item 109, on the neck that prevents the cap from uplifting and rotating until such time that the tamper-evident lower skirt, Item 97, is removed by means of pull tab, Item 91.

Figure 11:
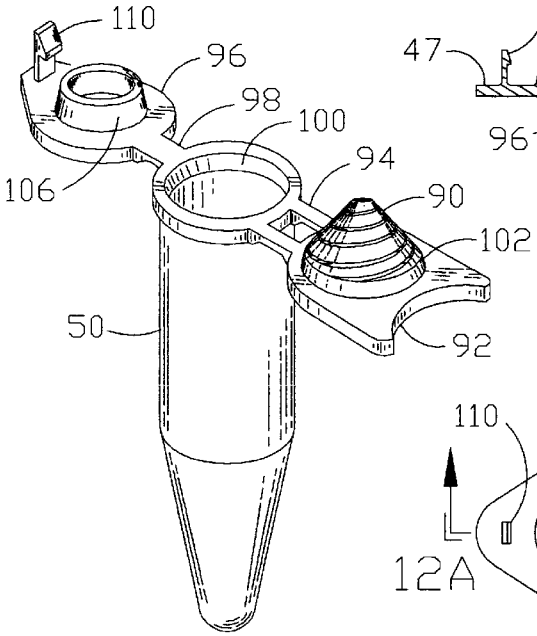
FIG. 11 is a perspective view of a multiple cap container with wiping cap and locking cap.

Another embodiment, FIGS. 11, 12 12A and 13, shows an alternative to my "Sealing Cap for Container" U.S. Pat. No. 5,513,768 with the replacement of the convex sealing diaphragm with a pipette tip wiping configuration. FIG. 11 shows a perspective view of the two cap design with the spiral wiping fingers 90 molded into the wiping cap 92 attached to the container tube 50 by a hinge 94. Locking Cap 96 is molded 180 degrees opposite the wiping cap 92 and is connected to tube 50 by hinge 98, which completes the one-piece injection molded assembly. In use the tube 50 would be filled with fluid, wiper cap 92 would then be rotated into the tubes tapered sealing surface 100 mating with the wiping cap 92 sealing surface 102. To access the tubes fluid with a pipette tip, you would pass the tip through the spiral wiping finger or fingers 90, by expanding them, draw the calibrated sample fluid into the pipette tip 115, withdraw the tip from the tube 50 and transport the sample to its location for its dispensing. Unlike prior art, during the withdrawal cycle the wiping fingers 90, contract about the outside surface of the pipette tip 115 and removed all fluid droplets 117 from the outside of the tip and leave it within tube 50 as shown in FIG. 16.

Figure 13:
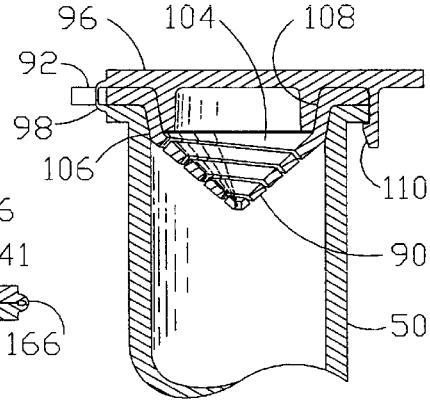
FIG. 13 is a side section of FIG. 11 in its sealed state (one piece assembly).
Figure 15:
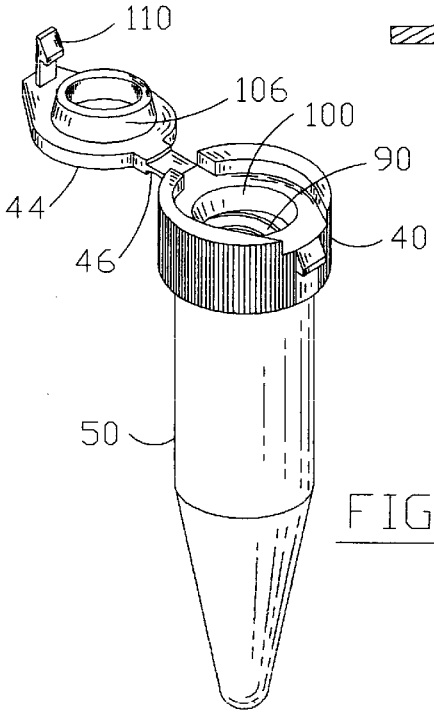
FIG. 15 is a perspective view of a single cap seal with wiping finger.

After the sample has been accessed you can seal the tube 50 as shown by FIG. 13 by rotating locking cap 96 about hinge 98 into wiper cavity 104 mating locking caps sealing surface 106 with wiper cavity sealing surface 108. This sandwiches the wiper wall section 102 and 108 between the locking cap 106 surface and tube 50 sealing wall 100 for added leak protection. Locking cap 96 is held into position by locking finger 110 and hinge 98 which does not allow any upward movement while in the closed position.

Figure 14:
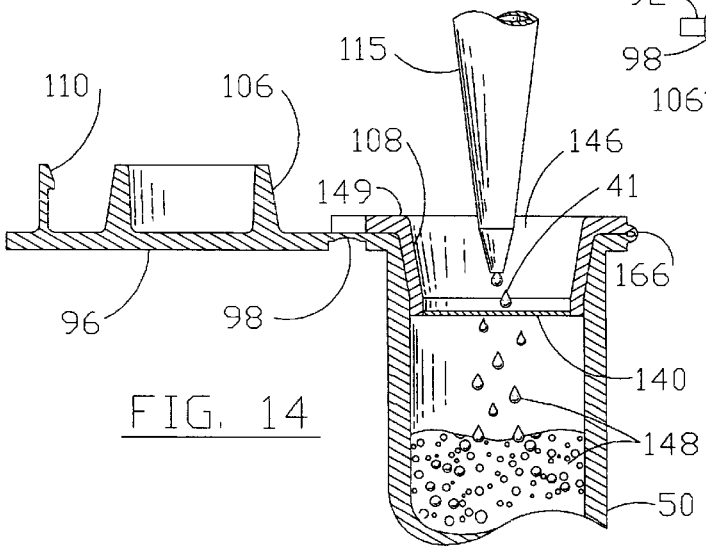
FIG. 14 is a side section of a multiple cap vial with filter cap and locking cap.

Another variation of the double cap embodiment, FIG. 14, shows the Spiral Finger Wiper 90 being replaced with a molded-in filter screen or sealingly attached microporous filter membrane, Item 140. This allows incoming unfiltered fluid 141 to enter tube 50 by means of filter 140 or variations thereof to become filter fluid 148.

Figure 3A:
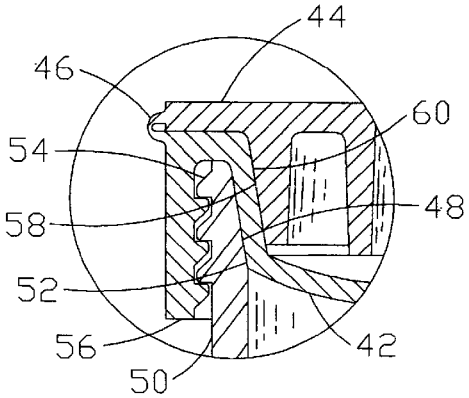
FIG. 3A is an exploded view of FIG. 3.
Figure 17:
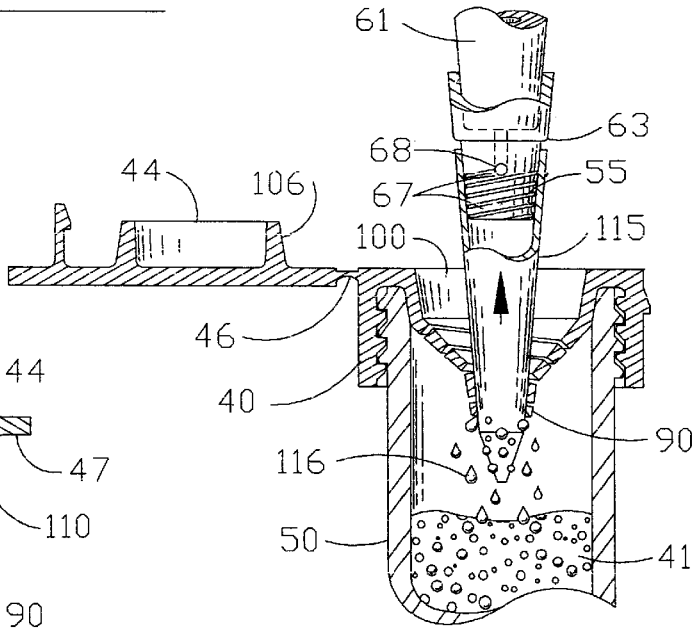
FIG. 17 is a side section of FIG. 15 showing a pipette tip after leaving the wiping cap.
Figure 18:
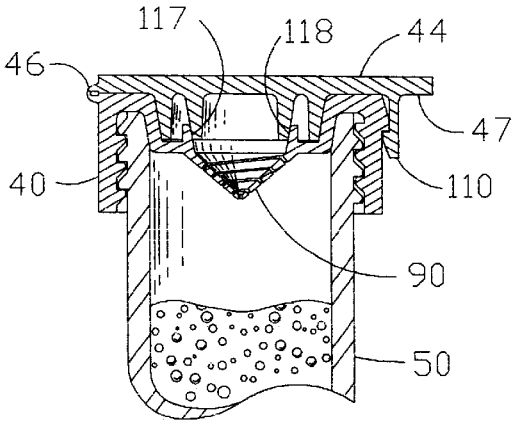
FIG. 18 is a side section of FIG. 15 shown in a sealed state.

A single cap variation of the spiral wiping finger is shown in FIGS. 15–18. This embodiment is also a one-piece injection molded closure design incorporating a threaded skirt 40 attached to access cap 44 by hinge 46. Its sealing and locking features are the same as is shown and described by FIGS. 3 and 3A. However, the convex sealing diaphragm 43 has been replaced with spiral wiper finger 90. FIG. 16 shows a pipette tip 115 that has entered the fluid contents 41 of tube 50 by expanding the fingers of the spiral wiper 90 and has withdrawn its sample fluid. As the tip is retracted from the fluid, there exists fluid in the form of film or droplets 116 on the outside surface of the tip 115. This is due to the surface tension of plastic tip material, usually polypropylene, to attract the fluid. As the tip 115 is drawn upwards out of the tube as shown in FIG. 17, the spiral finger 90 contracts about its conical surface while wiping all of the fluid 116 from its outside surface back into the container. This leaves the outside surface of the tip 115 clean and ready to be transported to its next location for dispensing. The container can now be closed and sealed for further use. In addition to the sealing surfaces as described by FIGS. 3 and 3A there can exist mating surfaces 117 of the access cap 44 and 118 of the wiping finger cavity which can also form an additional seal as shown in FIG. 18 closed and sealed position. It is also understood that cap 40 can attach to its container 50 by means other than thread (i.e. snap, press fit, etc.).

Figure 19:
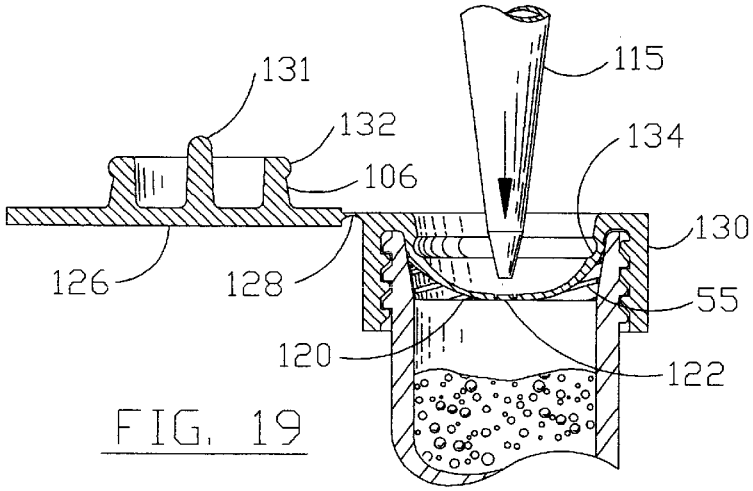
FIG. 19 is a side section of a vented elastic closure with molded in septum for needle injection or wiping pipette tips.

FIG. 19 shows another embodiment of a wiping concept utilizing an injection moldable thermoplastic elastomer such as SANTOPRENE manufactured by Monsanto Chemical Company. Using this rubber-like material allows the design freedom to mold a very thin wiping diaphragm 120 with a small hole 122 for entry or a breakaway hinged plug with frangible means that could be punctured to be opened. This hole 122 will expand and contract about the pipette tip wiping any fluid from its outside surface upon tip withdrawal because of the elastic characteristic of the thermoplastic elastomer. There also exists small channel vents 55 in the wiping diaphragm sealing surface as described previously that insure atmospheric pressure is stabilized within the container upon entry and removal of the pipette tip. Without this vent, fluid could be pushed upward into the tip itself due to the pressure that would be caused within the sealed container upon entry of the tip thus effecting the calibrated fluid level.

After pipetter withdrawal the access cap 126 can be rotated about hinge 128 into threaded skirt 130 to make a snap seal with cap projection 132 and diaphragm undercut 134. It is understood a finger-like projection 131 could be molded to access cap 126 to mate and seal with hole 122 and this combination could also be insert molded as one part with two different materials similar to that shown in FIG. 6B. It is also understood some applications would not require an access cap 126 and thus would only be molded with a skirt 130 (threaded or non-threaded) and wiper 120.

The benefits of this new wiper design are many, keeping all excess fluid within the container while 1) eliminating the necessity to wipe the outside surface of the tip with tissue; 2) Reduces contamination associated with pipetting hazardous materials; 3) Minimizes potential fluid loss and contamination due to spillage; 4) Increases the accuracy and precision of the dispensed sample by eliminating the possibility of outside surface fluid combining with the calibrated interior sample volume; 5) Reduces the time required to perform pipetting tasks; 6) Saves valuable sample fluids while prolonging sample life and; 7) Minimizes air exchanges within the container.

Figure 20A:
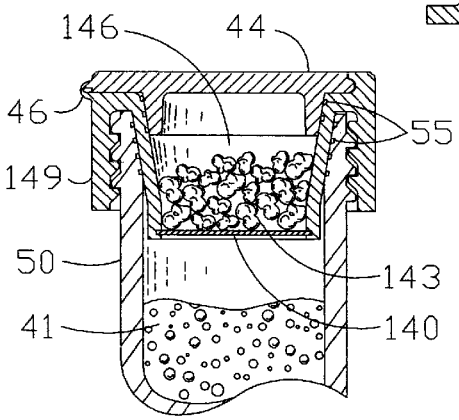
FIG. 20A is a side section with filter cavity filled with reagents, oxygen scavenging material, reactant, chemical fluids, etc.
Figure 20:
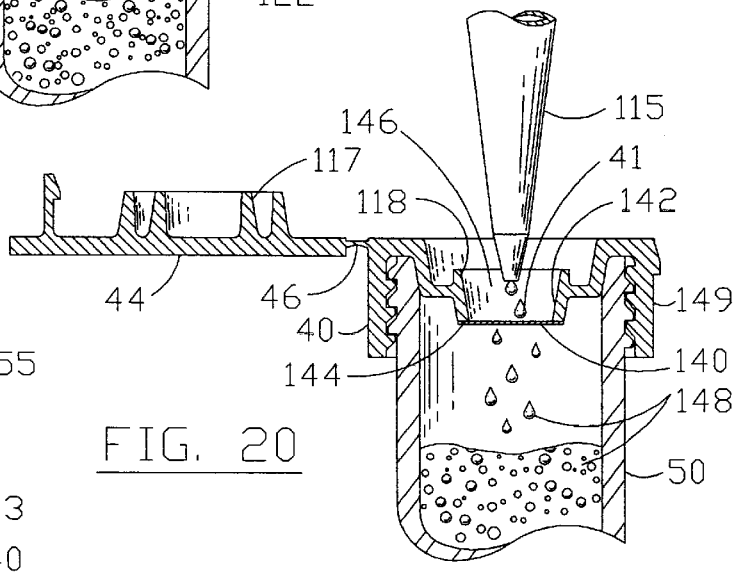
FIG. 20 is a side section, of a single cap closure with filter sealingly attached.

FIG. 20 shows a closure according to another embodiment of the present invention. As shown, microporous filter membrane 140 has been sealingly attached to conical wall section 142 at annular ring 144 creating cavity 146. This single cap embodiment allows cap 40 to filter incoming unfiltered sample fluid from tip 115 prior to entering tube container 50, thus the tubes fluid contents become filtered sample fluid 148 once it passes through hydrophilic filter membrane 140. This can be useful in sterilizing or clarifying fluids while also being used for straining or screening solutions depending on the application and chemicals involved, the microporous membrane can be manufactured from PTFE, nylon, polysulfone etc. with pore size as low as 0.45 or 0.1 um if need be. After the container is full, access cap 44 can then be sealed to cap 40 for storage. Another variation of this embodiment could be that the membrane 140 be impregnated with one or more substances that would react to the sample as the fluid flows through the filter 140, combining particular chemicals with the fluid samples for testing or evaluation purposes. An example of this might be as a sample of urine or serum is dispensed into cavity 146, it wets out and moves through membrane 140 and it solubilizes one or more reagents or reactants that have been previously deposited into the membranes 140 bed volume possibly causing a color change to occur in the container.

Another variation would be to fill cavity 146 with dry peletized reagents that would also mix and dissolved with the fluid sample as it passes through the filter. It is also understood that the filter 140 and conical wall section 142 could be molded with very small openings to simulate a filter screen without the need of a separate membrane filter 140 in some applications thus reducing the manufacturing cost. A variation of this embodiment would be to install a hydrophobic membrane 140, pre-fill the closure cavity 146 with a pre-determined chemical fluid such as a reactant. Then install this closure onto a vial 50 which had been previously filled with a pre-determined amount of fluid such as blood. Upon centrifugation, the fluid within the cavity of the closure will pass through membrane 140 thus filtering the fluid while also mixing with the fluid within the container performing a test or analysis. Previously described vents in both the closure and closure cavity would be required to compensate for the reduced pressure formed within the cavity 146 by the transfer of the fluid into the vial and the increased pressure of the vial due to the fluid transfer. These new embodiments would allow manufactures to ship containers pre-loaded with many or all of the reagents or chemicals that would be required to complete an analysis or test requirements. An alternative to dry peletized reagents would be to fill cavity 146 with oxygen scavenging pellets similar to AGELESS manufactured by Mitsubishi Gas Chemical Corporation Inc. that would absorb oxygen from the gasses contained within the sealed tube 50. This would prolong the life of the oxygen sensitive samples and decrease the aging effects associated with oxidation. A hydrophobic filter membrane 140 could be used in this application to allow air exchange between chambers without the possibility of fluid contamination. In another variation cavity 146 would be molded with a multitude of ribs with small passages to increase the surface area inside the cavity without the need of filter 140. This configuration would allow the entire closure to be molded from a polymer with SMARTMIX oxygen absorbing additive made by Advanced Oxygen Technologies Inc. This one-piece molded closure would help remove headspace oxygen while also limiting oxygen ingress into the container thus extending product sample life while preventing product degradation.

Another embodiment would be to use a hydrophobic filter membrane item 140 that has been treated with coatings comprising a general disinfecting activity such as bactericidal, fungicidal etc. This filter membrane would allow sterile venting of the container 50 by allowing only ultrapure air to pass while preventing any fluids or aerosols to pass. Typical applications include sterile venting of volatile and decomposing chemicals, autoclaving, fermentation etc. with the ability to reseal the container with access cap 44.

Figure 21:
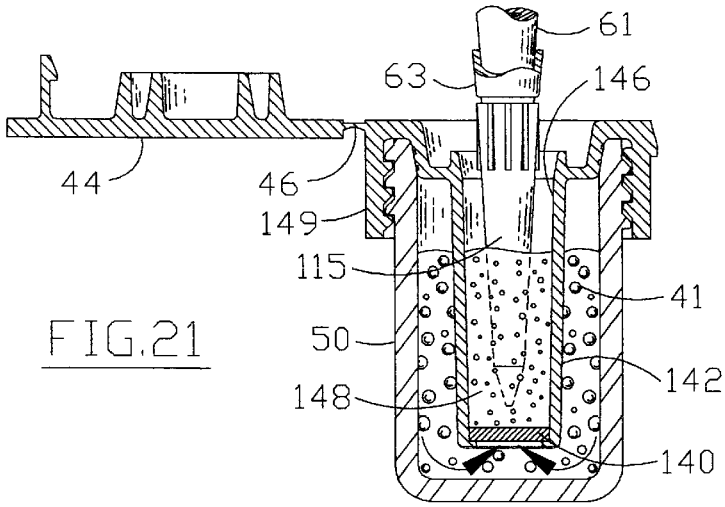
FIG. 21 is a partial side section of a deep filter closure shown within the containers fluid.

FIG. 21 shows the extension of conical wall 142 into the unfiltered fluid 41 that will pass through filter membrane 140 to fill cavity 146 with only filter fluid 148. This now allows pipette tip 115 to access the container 50 and only withdraw filtered sample fluid 148 instead of the unfiltered fluid 41. It is also understood that besides molding small openings in cavity 146 to filter or screen fluids, a plastic porous plug, similar to those manufactured by POREX Corporation, could be pressed to fit into cavity 146 to accomplish similar results.

Figure 22:
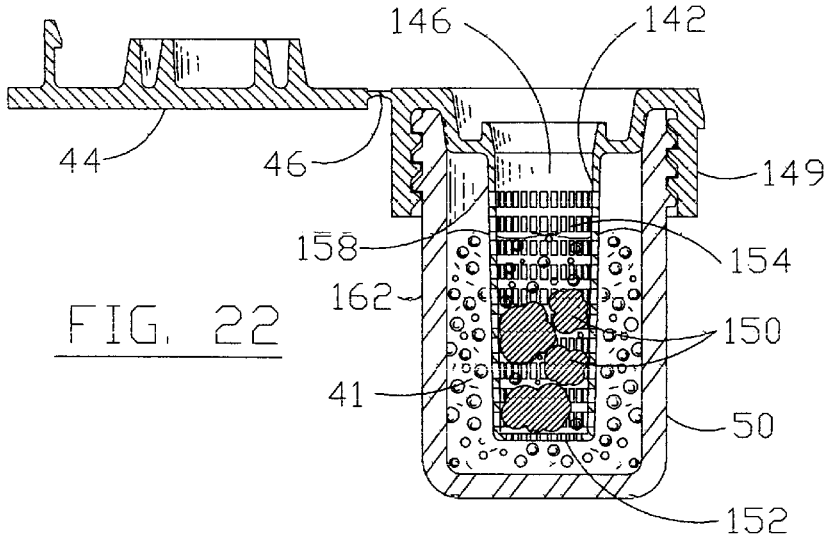
FIG. 22 is a partial side section of a tissue storage closure with openings.
Figure 23:
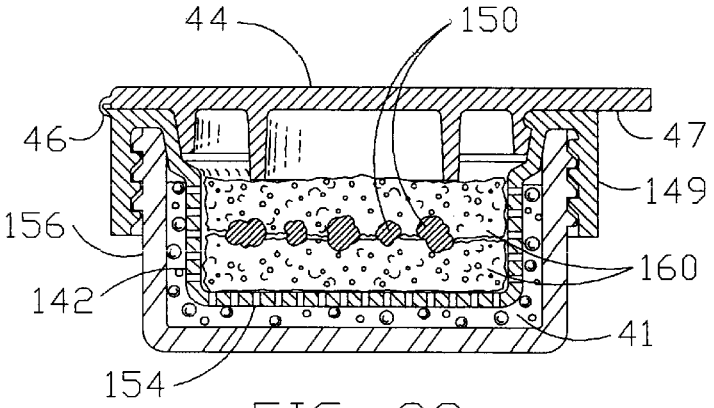
FIG. 23 is a side section of tissue storage closure with biopsy sponges with openings.

FIG. 22 shows an embodiment similar to FIG. 21 except that it will be used for the storage or processing of tissue or other specimens. In its use, the container 50 will be filled with a chemical such as formaldehyde for disinfecting and preserving the specimens or other chemicals used for tissue decalcifier, staining, solvents etc. The cap 149 will then be installed and tissue specimens 150 can be deposited into cavity 146 for storage or processing. Conical wall section 142 and its bottom 152 will be molded with tiny flow through openings 154 to allow maximum fluid exchange and ensure proper drainage upon removal of cap 149 from its container 162. Access cap 44 will still be used to hermetically seal the container for storage while still allowing access to the specimens as with previous embodiments. A variation of this one piece injection molded closure would be the replacement of conical wall section 142 with a insert molded porous paper or plastic screen biopsy bag that would attach at location 158 as shown in FIG. 22. This would then allow the user to remove the bag from the storage container 162 by disengaging it from the cap 149 and be used for farther evaluations and/or testing as are normal biopsy bags used in histology laboratories. A variation of this last embodiment is shown in FIG. 23 where the small tissue specimens 150 are sandwiched between two open cell foam pieces 160 made from a material such as polyester. The foam acts to hold smaller specimens or fragments in a suspended format reducing the risk of lost tissue while still allowing chemicals to flow easily around the specimens.

Figure 12A:
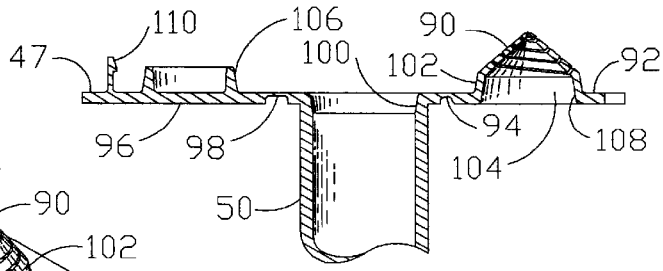
FIG. 12A is a partial side section (tube only) of FIG. 12.
Figure 12:
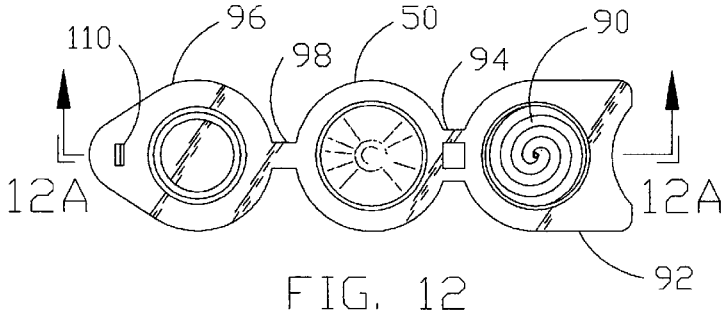
FIG. 12 is a top view of FIG. 11.
Figure 24:
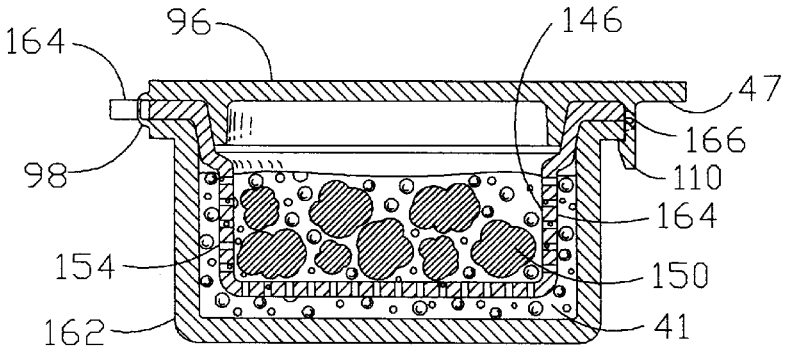
FIG. 24 is a side section of a multiple cap closure for tissue storage with openings.

In another storage cap closure embodiment FIG. 24 shows a single piece multiple cap design similar to previous FIGS. 11, 12 and 13. In this embodiment the container 162 is molded to perforated cap 164 by hinge 166 and Locking Sealing Cap 96 by hinge 98 making this a one-piece injection molded assembly. FIG. 24 shows how tissue specimens 156 will be placed into the perforated cap 164. This cap is submersed into a fluid 41 such as formaldehyde for storage or testing purposes. The locking/sealing cap 96 is then rotated about its hinge 98 to make seal with the perforated cap 164 while locking itself onto container 162 with locking finger 110 and thus sealing the container. This embodiment would also work well in either a round or rectangular configuration. It could also be used with open cell foam 160 for holding smaller specimens as shown in FIG. 23.

One advantage of these storage closures is the minimal use of fluids necessary to contain the specimens. Second, the closure with its contents can easily be moved to other containers for further procedures such as staining or other evaluations. Third, is convenience and accessibility while the most important advantage is its simplicity which reduces the manufacturing costs which is the greatest concern with any disposable product.

It is believed that many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited by the scope of the following claims.

39 Access Cap Vent Plug
40 Sealing Cap (Linerless)
41 Unfiltered Fluid
42 Convex Diaphragm
42A Convex Diaphragm Seal
43 Minimal Wall Access (Diaphragm)
44 Access/Locking Cap (Integral)
45 Finger Lock
46 Hinge
47 Access Tab (Locking Cap)
48 Angled Wall (Seal)
48A Diaphragm Wall Seal
48B Diaphragm Wall Seal (Maze)
49 Locking Cap (No Access)
49A Access/Locking Cap (Independent)
50 Centrifuge Tube
51 Spring Back-up, Convex
52 Angled Tube Wall (Seal)
52A Tube/Neck Wall
53 O-Ring, Back-up or Coil Spring
54 Tube/Neck External Threads (Full or Partial)
54A Tube/Neck (Interior Thread)
55 Small Vent Channels (3–100 microns)
56 Threaded Skirt (Interior Thread—Full or Partial)
56A Threaded Skirt (Exterior Threads)
57 Channel Vent—Beginning
57A Annular Recess (Tube)
58 Diaphragm Wall (Inside-Seal)
59 Channel Vent—Exit
60 Access Cap Wall (Outside-Seal)
61 Pipetter Barrel
62 Sealing Cap Undercap Snap
63 Filter Adapter
64 Access/Locking Cap Projection Snap
65 Finger Stop (Convex Wall)
66 Textured Filter Surface (i.e. 3–50 microns)
67 Filter Adapter Sealing Surface
68 Hole, Filter Adapter
68A Hole, Vent Needle
68B Hole, Vent Cap
69 Inside Wall, Container
70 Tethered Cap
71 Syringed Needle
72 Tethered Hinge
73 Septum
73A Septum Insert
74 Thread Lead-In (Cap)
75 Thread Profile (Cap)
76 Thread Lead-In (Tube/Neck)
77 Thread Profile (Tube/Neck)
78 Tether Ring
79 Needle Hub
80 Tether Ribs
81 Needle Seal
82 Shear Points, Rib
83 Hub Entry Wall
84 Tethered Ring Holder
85 Tapered Hub Nose
86 Syringe
87 Blow Molded Bottle
88 Flange, Stop (Needle)
89 Neck
90 Spiral Finger Wiper
91 Pull Tab
92 Wiping Cap
93 Frangible Section
94 Hinge, Wiper
95 Neck Flange
96 Locking, Sealing Cap
97 Lower Skirt
98 Hinge, Locking
99 Anti-Rotate Projections
100 Sealing Wall, Tube
101 Shoulder Locking Wall
102 Sealing Wall, Wiper
103 Snap, Cap
104 Cavity, Wiping Cap
105 Snap, Neck
106 Sealing Wall, Locking Cap
107 Snap, Anti-Rotate
108 Sealing Wall, Wiping Cap (Inside)
109 Snap, Anti-Rotate, Neck
110 Locking Finger
115 Pipette Tip
116 Fluid Droplets
117 Seal, Access Cap
118 Seal, Wiper Cavity
120 Diaphragm, Elastomer
121 Tamper Evident Diaphragm
122 Diaphragm, Access Hole, or Breakaway Hole
123 Carton Panel
126 Access Cap, Elastomer
128 Hinge, Elastomer
130 Threaded Skirt, Elastomer
131 Finger-Like Projection
132 Seal Snap, Access Cap
133 Recess, Cap
134 Seal Snap, Wiper Cavity
135 Access Hole, Passcore
136 Septum, Elastomer
140 Filter Membrane
142 Conical Wall Section
143 Pellet (i.e. reagents oxygen scavenging etc.)
144 Sealing Ring Anus
146 Cavity, Conical
148 Filtered Fluid
149 Cap Filter
150 Tissue Specimens
152 Bottom, Conical
154 Opening, Filter Cavity
156 Container, Wide Mouth
158 Screen Bag Attachment
160 Open Cell Foam
162 Container, Multiple Cap
164 Cap, Perforated
166 Hinge, Multiple Cap

What is claimed is:

1. A sealable containing comprising:

a tubular member having an open end and an inner wall;

a deformable sealing cap including a base and a cup shaped member extending from said base, said cup shaped member having an open end adjacent said base and a closed end comprising a generally convex end wall bulging outwardly in a direction away from said open end and being configured to occlude said tubular member when said cup shaped member is inserted through the open end of said tubular member, said cup shaped member including a tubular section between said base and generally convex end wall, said tubular section having a frustoconical outer and inner wall surface, the diameter of said wall surfaces adjacent said generally convex end wall being less than the diameter of said wall surfaces adjacent said base, said sealing cap including means for securing said sealing cap to said tubular member; and a locking cap coupled to said base, said locking cap having a portion configured for being received within said cup shaped member and sized to prevent said convex end wall from being inverted into a concave configuration when said cup shaped member is positioned in said tubular member and said portion of said locking cap is positioned within said cup shaped member.

2. The sealable container of claim 1 wherein said locking cap includes means for engaging an annular groove in said deformable sealing cap.

3. The sealable container of claim 1 wherein said sealing cap includes means for facilitating the puncturing of said convex end wall.

4. The container of claim 1 wherein, said tubular section contains a pre-determined vent texture surface with means for allowing gas diffusion into and out of said tubular member.

5. The container of claim 4 wherein said vent texture prohibits the flow of aerosols or fluid therethrough.

6. The sealable container of claim 1 further including venting means between said cup shaped member and said tubular member for venting the interior of said tubular member.

7. The sealable container of claim 6 wherein said locking cap includes means for prevention of venting of the interior of said tubular member.

8. The sealable container of claim 1 wherein said cup shaped inner wall is configured to receive and seal said locking cap wall sandwiching said tubular section between said locking cap and said tubular member.

9. A sealable container of claim 8 wherein said locking cap has a top section engagable with a portion of said sealing cap, said top portion providing access into said sealing cap without breaking the seal between frustoconical surfaces of said sealing cap and said tubular member.

10. A sealable container of claim 9 wherein said locking cap is attached to said sealing cap by means of a hinge, said hinge being configured such that when said caps are locked together significant movement of said locking cap is away from the open end of said tubular member and is precluded without deformation of said hinge.

11. The container of claim 1 wherein said tubular section includes at least one predetermined vent channel with means for allowing gas diffusion into and out of said tubular member.

12. The container of claim 11 wherein the said vent channel is helical.

13. The container of claim 11 wherein said vent channel prohibits the flow of aerosols or fluid therethrough.

14. The container of claim 11 wherein said inner wall of said tubular member includes a groove in the vicinity of said open end of said tubular member, said groove generally corresponding in configuration to an annular ring on said frustoconical outer wall section of said convex end wall.

15. A sealable container comprising:

a tubular member having an open end and an inner wall;

a deformable sealing cap including a base and a cup shaped member extending from said base, said cup shaped member having an open end adjacent said base and a closed end comprising a generally convex end wall bulging outwardly in a direction away from said open end and being configured to occlude said tubular member when said cup shaped member is inserted through the open end of said tubular member, said sealing cap including means for securing said sealing cap to said tubular member;

a locking cap coupled to said base, said locking cap having a portion configured for being received within said cup shaped member and sized to prevent said convex end wall from being inverted into a concave configuration when said cup shaped member is positioned in said tubular member and said portion of said locking cap is positioned within said cup shaped member; and a resilient metal backing on said cup shaped member, said metal backing being on the inside surface toward said open end.

16. A sealable container comprising:

a tubular member having an open end and an inner wall;

a deformable sealing cap including a base and a cup shaped member extending from said base, said cup shaped member having an open end adjacent said base and a closed end comprising a generally convex end wall bulging outwardly in a direction away from said open end and being configured to occlude said tubular member when said cup shaped member is inserted through the open end of said tubular member, said sealing cap including means for securing said sealing cap to said tubular member;

a locking cap coupled to said base, said locking cap having a portion configured for being received within said cup shaped member and sized to prevent said convex end wall from being inverted into a concave configuration when said cup shaped member is positioned in said tubular member and said portion of said locking cap is positioned within said cup shaped member; and a resilient rubber backing on said cup shaped member, said rubber backing being on the inside surface toward said open end.

17. A sealable container comprising:

a tubular member having an open end and outer and inner walls, said inner wall being tapered so that the inside diameter of said member is larger adjacent said open end;

a sealing cap including a top and taper cup shaped member extending from said top, said cup shaped member having a larger open top end adjacent said top and a smaller bottom end, said cup shaped member configured to occlude said tubular member when said cup shaped member is inserted through said open end of said tubular member, said sealing cap including means for securing said sealing cap to said tubular member; and a locking cap coupled to said base of said sealing cap, said locking cap being configured to sandwich said tapered cup shaped member between said tubular member and said locking cap when said locking cap is positioned in said cup shaped member.

18. The sealable container of claim 17 wherein said means for securing includes threads formed on the outer wall of said tubular member and mating threads formed on a threaded skirt attached to and depending from the periphery of said base of said sealing cap.

19. The sealable container of claim 17 wherein the closed end of said cup shaped member is imperforate and is constructed from a rubber-like self sealing material.

20. The container of claim 17, wherein said taper cup shaped member includes at least one predetermined vent channel with means for allowing gas diffusion into and out of said tubular member and including means for trapping fluid.

21. The sealable container of claim 17 further including a pierceable sealing element located inside said cup shaped member.

22. The sealable container of claim 17 wherein said convex end wall includes a breakaway disk with frangible means.

23. The sealable container of claim 17 wherein said bottom end comprising an annular opening is constructed from a rubber-like self sealing material.

24. The sealable container of claim 23 wherein said locking cap includes a finger-like projection sized to seal opening in said bottom end of said cup shaped member.

25. A sealable container comprising:

a tubular member having an open end and outer and inner walls, said inner wall being tapered so that the inside diameter of said member is larger adjacent said open end;

a sealing cap including a top and taper cup shaped member extending from said top, said cup shaped member having a larger open top end adjacent said top and a smaller bottom end, said cup shaped member configured to occlude said tubular member when said cup shaped member is inserted through said open end of said tubular member, said sealing cap including means for securing said sealing cap to said tubular member; and means on said taper cup shaped member for allowing gas diffusion into and out of said tubular member.

26. A sealable container comprising:

a tubular member having an open end and an inner wall;

a deformable sealing cap including a base and cup shaped member extending from said base, said cup shaped member having an open end adjacent said base and a closed end comprising a generally convex end wall bulging outwardly in a direction away from said open end and being configured to occlude said tubular member when said cup shaped member is inserted through the open end of said tubular member, said cup shaped member adjacent said inner wall of said tubular member including at least one predetermined vent channel with means for allowing gas diffusion in and out of said tubular member, said sealing cap including means for securing said sealing cap to said tubular member; and a locking cap coupled to said base, said locking cap having a portion configured for being received within said cup shaped member and seized to prevent said convex end wall from being inverted into a concave configuration when said cup shaped member is positioned in said tubular member and said portion of said locking cap is positioned within said cup shaped member.

* * * * *

UNITED STATES PATENT AND TRADEMARK OFFICE

CERTIFICATE OF CORRECTION

PATENT NO. : 6,145,688
DATED : November 14, 2000
INVENTOR(S) : James C. Smith

It is certified that error appears in the above-identified patent and that said Letters Patent is hereby corrected as shown below:

Title page, Inventors, address should be: -- James C. Smith, 336 Harbor Road, Hayward, CA 94544 --.

Signed and Sealed this

First Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,145,688
DATED : November 14, 2000
INVENTOR(S) : James C. Smith

It is certified that error appears in the above-identified patent and that said Letters Patent is hereby corrected as shown below:

Title page,
Item [76], Inventors Address should read as follows:

James C. Smith
336 Harder Road
Hayward, CA 94544

Signed and Sealed this

Eleventh Day of September, 2001

*Attest:*

Nicholas P. Godici

NICHOLAS P. GODICI
*Acting Director of the United States Patent and Trademark Office*

*Attesting Officer*